US009964876B2

(12) United States Patent
Toyoizumi et al.

(10) Patent No.: US 9,964,876 B2
(45) Date of Patent: May 8, 2018

(54) TONER AND METHOD FOR MANUFACTURING THE SAME

(71) Applicant: CANON KABUSHIKI KAISHA, Tokyo (JP)

(72) Inventors: Noritaka Toyoizumi, Mishima (JP); Yusuke Kosaki, Susono (JP); Tetsuya Kinumatsu, Mishima (JP); Kenji Aoki, Numazu (JP); Toshifumi Mori, Tokyo (JP); Sakae Suda, Yokohama (JP); Shinnosuke Koji, Yokohama (JP); Shuntaro Watanabe, Hadano (JP); Kazumichi Nakahama, Suntou-gun (JP); Atsushi Tani, Tokyo (JP); Takashige Kasuya, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/658,161

(22) Filed: Jul. 24, 2017

(65) Prior Publication Data

US 2018/0031988 A1 Feb. 1, 2018

(30) Foreign Application Priority Data

Jul. 27, 2016 (JP) ..... 2016-147265

(51) Int. Cl.
*G03G 9/087* (2006.01)
*G03G 9/08* (2006.01)
(Continued)

(52) U.S. Cl.
CPC ..... *G03G 9/0825* (2013.01); *G03G 9/0819* (2013.01); *G03G 9/0821* (2013.01);
(Continued)

(58) Field of Classification Search
CPC ..... G03G 9/08773; G03G 9/09307; G03G 9/09314; G03G 9/09342
See application file for complete search history.

(56) References Cited

FOREIGN PATENT DOCUMENTS

JP 07-181722 * 7/1995 ..... G03G 9/087
JP 2006-91283 A 4/2006
(Continued)

OTHER PUBLICATIONS

Translation of JP 07-181722 published Jul. 1995.*

*Primary Examiner* — Peter L Vajda
(74) *Attorney, Agent, or Firm* — Canon U.S.A., Inc. IP Division

(57) ABSTRACT

A toner includes toner particles which contain a binder resin, a colorant, a wax, and a resin A having an organic polysiloxane structure; the amount of Si atoms of the toner particles is 4.5 to 10.0; in an analysis of a cross-section of each toner particle, in a surface layer region R from the periphery of the cross-section of the toner particle to the inside at a distance of 10.0% of the particle diameter in the cross-section of the toner particle, the content of Si atoms derived from the organic polysiloxane structure is 90.0% or more with respect to the total amount of Si atoms contained in the toner particle; and in a line analysis along a straight line between the periphery of the surface layer region R and a gravity center of the cross-section, an intensity count of Si atoms in the toner particle satisfies formula $Si^0>Si^1>Si^2>Si^3\geq 0$.

10 Claims, 4 Drawing Sheets

(51) Int. Cl.
*G03G 9/097* (2006.01)
*G03G 9/09* (2006.01)

(52) U.S. Cl.
CPC ..... *G03G 9/08755* (2013.01); *G03G 9/0918* (2013.01); *G03G 9/09775* (2013.01)

(56) References Cited

FOREIGN PATENT DOCUMENTS

| | | | |
|---|---|---|---|
| JP | 2010-132851 | A | 6/2010 |
| JP | 2013-137495 | A | 7/2013 |
| JP | 2015-106078 | A | 6/2015 |

* cited by examiner

TONER AND METHOD FOR MANUFACTURING THE SAME

BACKGROUND OF THE INVENTION

Field of the Invention

The present disclosure relates to a toner used for an electrophotographic method, an electrostatic recording method, and a toner jet type recording method and a method for manufacturing the toner.

Description of the Related Art

In recent years, in a copying machine and a printer, each of which uses an electrophotographic method, in view of energy saving, an attempt to improve a so-called low-temperature fixability has been made so as to significantly reduce the amount of heat applied to a fixing device. In addition, in response to the increasing spread of those devices into various markets including a home consumer market, those devices are also required to stably form a high-quality image in various temperature and humidity environments.

Hence, a toner is required to have, besides a low-temperature fixability, an environmental stability so as not to be adversely influenced by the temperature and humidity.

The toner is also required to have, besides the low-temperature fixability, a storage stability. In order to simultaneously satisfy the above two properties, a toner having a core-shell structure in which a surface of a resin used as a core is covered with a shell resin has been proposed.

As a method to improve the environmental stability of the toner, there may be mentioned a method in which as a shell-forming resin of a toner having a core-shell structure, a hydrophobic material which is not likely to be influenced by the temperature and humidity is used. As the hydrophobic material, an organic polysiloxane has been known as a material having a low surface tension. Accordingly, when a resin having an organic polysiloxane structure is introduced into a shell resin of the toner, a charging performance which is not influenced by the humidity is expected to be obtained. However, in general, since the organic polysiloxane generally has a glass transition temperature (Tg) lower than room temperature, when a large amount thereof is contained in the shell resin, the surface of each toner particle is softened, and the durability thereof is degraded. Accordingly, it is important to control the amount of the organic polysiloxane to be introduced and the presence state thereof.

Japanese Patent Laid-Open No. 2006-91283 has proposed a toner having a core-shell structure in which an organic polysiloxane compound is contained in a core resin and a shell resin. According to this proposal, a toner excellent in peel property from a fixing roller and excellent in chargeability can be obtained.

Japanese Patent Laid-Open No. 2010-132851 has proposed a method for manufacturing a toner having a surface to which resin fine particles having an organic polysiloxane structure is fixed or on which a film is formed therefrom. According to the method described above, toner particles are formed in such a way that as a dispersion medium, carbon dioxide in a liquid form or in a supercritical state is used, and resin fine particles and a compound having an organic polysiloxane functioning as a dispersion stabilizer are dispersed in the dispersion medium.

Japanese Patent Laid-Open No. 2013-137495 has proposed a toner having a core-shell structure in which a shell layer is formed from the resin having an organic polysiloxane structure. In addition, it has also been disclosed that when the number of portions having an organic polysiloxane structure present on surfaces of toner particles is optimized, the environmental stability and the durability are simultaneously obtained.

However, according to the investigation carried by the present inventors, it was found that the toner disclosed in Japanese Patent Laid-Open No. 2006-91283 had not a sufficient low-temperature fixability. The reason for this is believed that since a large amount of the above polysiloxane compound is contained in the core resin, bleeding of a wax during fixing is also disturbed, and as a result, cold offset is liable to occur. When the chargeability of the toner disclosed in Japanese Patent Laid-Open No. 2010-132851 was investigated, it was found that the chargeability was liable to be influenced by the humidity, and the environmental stability was not good enough. In addition, it was also found that when a durability test was performed on the toner disclosed in Japanese Patent Laid-Open No. 2013-137495 after the toner was left for a long period of time in a severe temperature/humidity environment, image defect may be generated in some cases. The reason for this is believed that low molecular weight components in a wax and/or a binder resin contained in the toner particles bleed onto the surface of the toner, and as a result, degradation in chargeability and/or contamination of members is generated.

SUMMARY OF THE INVENTION

In consideration of the problems described above, the present disclosure provides a toner excellent not only in charging stability and environmental stability but also in low-temperature fixability and durability and a method for manufacturing the toner described above.

The present disclosure relates to a toner comprising toner particles which contain a binder resin, a colorant, a wax, and a resin A having an organic polysiloxane structure;

in the toner particles, the amount (atomic %) of Si atoms measured by an X-ray photoelectron spectroscopy (XPS) is 4.5 to 10.0;

in an analysis using an energy dispersive X-ray spectrometer (EDS) performed on a cross-section of each toner particle observed by a transmission electron microscope, in a surface layer region R from the periphery of the cross-section of the toner particle to the inside at a distance of 10.0% of the particle diameter in the cross-section of the toner particle, the content of Si atoms derived from the organic polysiloxane structure is 90.0% or more with respect to the total amount of Si atoms contained in the toner particle; and in a line analysis along a straight line between the periphery of the surface layer region R and a gravity center of the cross-section, an intensity count of Si atoms in the toner particle satisfies the following formula (1).

$$Si^0 > Si^1 > Si^2 > Si^3 \geq 0 \quad (1)$$

In the formula (1), $Si^0$ represents the intensity count of Si atoms at an intersection $P^0$ between the straight line and the periphery;

$Si^3$ represents the intensity count of Si atoms at an intersection $P^3$ between the straight line and a boundary line of the surface layer region R; and when points equally dividing a line segment $P^0P^3$ into three portions are represented by $P^1$ and $P^2$ in this order from the side close to the intersection $P^0$, $Si^1$ represents the intensity count of Si atoms at the intersection $P^1$, and $Si^2$ represents the intensity count of Si atoms at the intersection $P^2$.

In addition, the present disclosure relates to a method for manufacturing a toner including toner particles which contain a binder resin, a colorant, a wax, and a resin A having an organic polysiloxane structure, and the method comprises:

a) a step of preparing a resin solution including the binder resin, the colorant, the wax, the resin A having an organic polysiloxane structure, and an organic solvent;

b) a step of mixing the resin solution, resin fine particles containing a resin B having an organic polysiloxane structure, and carbon dioxide to form liquid droplets of the resin solution having surfaces covered with the resin fine particles; and c) a step of removing the organic solvent contained in the liquid droplets to form toner particles having surface layers derived from the resin fine particles.

In the manufacturing method described above, the amount (atomic %) of Si atoms of the toner particles measured by an X-ray photoelectron spectroscopy (XPS) is 4.5 to 10.0; in an analysis using an energy dispersive X-ray spectrometer (EDS) performed on a cross-section of each toner particle observed by a transmission electron microscope, in a surface layer region R from the periphery of the cross-section of the toner particle to the inside at a distance of 10.0% of the particle diameter in the cross-section of the toner particle, the content of Si atoms derived from the organic polysiloxane structure is 90.0% or more with respect to the total amount of Si atoms contained in the toner particle; and in a line analysis along a straight line between the periphery of the surface layer region R and a gravity center of the cross-section, an intensity count of Si atoms in the toner particle satisfies the above formula (1).

Further features of the present disclosure will become apparent from the following description of exemplary embodiments with reference to the attached drawings.

DESCRIPTION OF THE EMBODIMENTS

Figure 1:
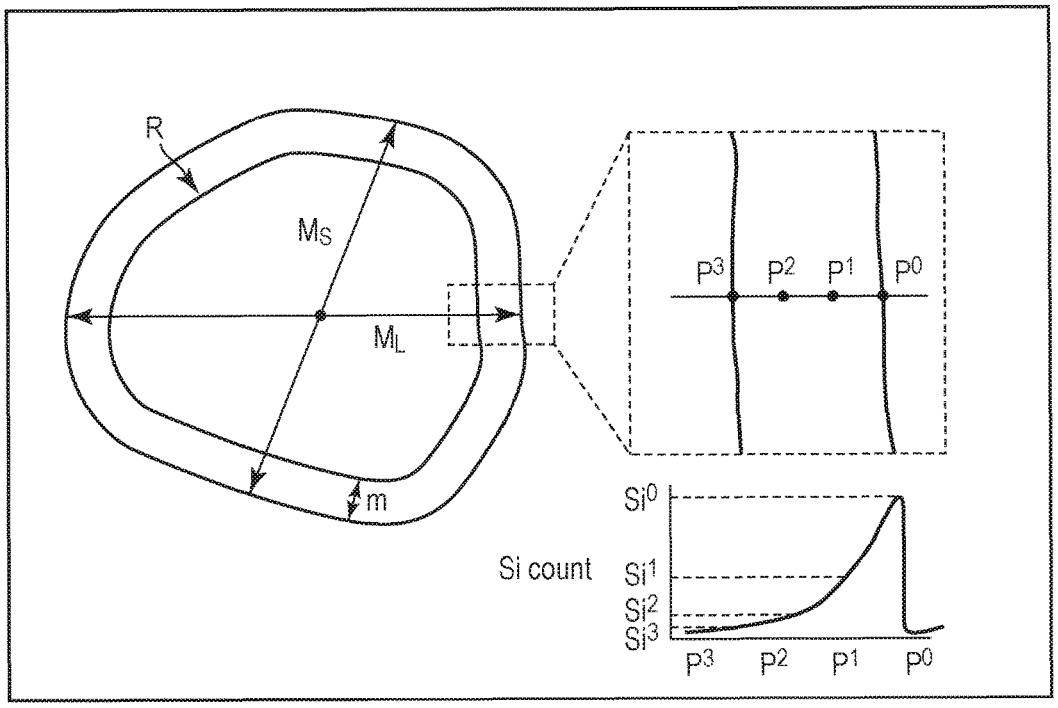
FIG. 1 is a view showing one example of a surface layer region R of a toner and positions of a line analysis.

A toner comprises toner particles which contain a binder resin, a colorant, a wax, and a resin A having an organic polysiloxane structure.

The organic polysiloxane structure has a repeating unit of a Si—O bond shown by the following formula (I) and has the structure in which two alkyl groups are bonded to each Si atom.

(I)

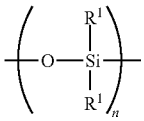

In the above formula (I), $R^1$ represents an alkyl group. In addition, n represents the degree of polymerization and is an integer of 2 or more. As described above, a compound having an organic polysiloxane structure tends to have a low surface tension.

Accordingly, since the resin A having an organic polysiloxane structure is present in surfaces of the toner particles, the environmental stability of the toner can be improved, that is, in particular, the change in charge amount of the toner in a high-temperature and high-humidity environment and a low-temperature and low-humidity environment can be likely to be suppressed.

As one method to solve the problem of durability which is generated when the toner is left for a long period of time in a severe temperature/humidity environment, a method in which the amount of the resin A to be introduced is increased may be mentioned. However, the above method may cause the degradation in low-temperature fixability. In addition, as another method, although a method in which the content of a portion having an organic polysiloxane structure contained in the resin A is increased may also be mentioned, since the surfaces of the toner particles are liable to be softened, the durability may be further degraded in some cases.

Hence, the present inventors focused on the introduction mode of the resin A into a surface layer of the toner particle and investigated in detail the relationship thereof with the environmental stability and the durability of the toner. As a result of this investigation, the present inventors found that when the amount of Si atoms in the surface layer of the toner particle derived form an organic polysiloxane structure and the presence state of Si atoms in the toner particle are controlled, the durability and the environmental stability described above can be simultaneously obtained, and as a result, the toner was finally made.

Hereinafter, the structure of the toner will be described in detail.

The amount (atomic %) of Si amount of the toner particle measured by an X-ray photoelectron spectroscopy (XPS) is 4.5 to 10.0. When the amount of Si atoms is set in the range described above, the environmental stability of charge amount can be secured.

By XPS, atoms present in the surface layer (in a region to a depth of approximately 10 nm) of a sample can be detected. In addition, by the chemical shift, the bonding states of atoms can be separated, and in the case of a Si—O bond derived from an organic polysiloxane structure, the peak is observed at 101 to 103 eV.

An amount of Si atoms smaller than 4.5 atomic % indicates that the amount of the organic polysiloxane structure in the surface layer of the toner particle is small, and the advantage of environmental stability of the charge amount may not be obtained. In addition, an amount of Si atoms larger than 10.0 atomic % indicates that the amount of the organic polysiloxane structure in the surface layer of the toner particle is large, and since the toner particle surface is softened, the durability is degraded. The amount of Si atoms is more preferably 6.0 to 9.0 atomic %. The amount of Si atoms of the toner particle described above may be controlled, for example, by the content of the resin A having an organic polysiloxane structure in the toner particle.

Next, in an analysis using an energy dispersive X-ray spectrometer (EDS) performed on a cross-section of the toner particle observed by a transmission electron microscope, a surface layer region R from the periphery of the cross-section of the toner particle to the inside at a distance of 10.0% of the particle diameter in the cross-section of the toner particle has the following characteristics. The content of Si atoms derived from the organic polysiloxane structure in the surface layer region R is 90.0% or more with respect to the total amount of Si atoms contained in the toner particle.

When the content of Si atoms derived from the organic polysiloxane structure is 90.0% or more in the surface layer region R, the resin A is locally present in the vicinity of the surface of the toner particle, and low molecular weight components of the wax and/or the binder resin can be suppressed from bleeding. When the content of Si atoms derived from the organic polysiloxane structure in the surface layer region R is smaller than 90.0%, the resin A is widely dispersed in the inside region of the toner particle, and the amount of the organic polysiloxane structure is small in the vicinity of the surface layer of the toner particle. As a result, the effect of suppressing the low molecular weight components of the wax and/or the binder resin from bleeding may not be sufficiently obtained in some cases. The content of Si atoms in the above surface layer region R is more preferably 95.0% or more.

In a line analysis along a straight line between the periphery of the surface layer region R and a gravity center of the cross-section, an intensity count of Si atoms in the toner particle has a gradient structure in which the intensity count of Si atoms is decreased from the periphery to the gravity center. That is, the intensity count of Si atoms in the toner particle satisfies the following formula (1).

$$Si^0 > Si^1 > Si^2 > Si^3 \geq 0 \quad (1)$$

In the formula (1), $Si^0$ represents the intensity count of Si atoms at the intersection $P^0$ between the straight line and the periphery. $Si^3$ represents the intensity count of Si atoms at the intersection $P^3$ between the straight line and a boundary line of the surface layer region R. When points equally dividing a line segment $P^0P^3$ into three portions are represented by $P^1$ and $P^2$ in this order from the side close to the intersection $P^0$, $Si^1$ represents the intensity count of Si atoms at the intersection $P^1$, and $Si^2$ represents the intensity count of Si atoms at the intersection $P^2$.

The present inventors considered a method to suppress further bleeding of the low molecular weight components of the wax and/or the binder resin contained in the toner particles. As a result, it was found effective that in order to suppress those bleedings, a structure in which the concentration of a component having an effect of suppressing the bleeding is increased and a structure in which a region of a component suppressing the bleeding is increased are provided in the vicinity of the surface of the toner particle. Although the above structures may be formed when the amount of the resin A to be introduced and/or the number of portions having an organic polysiloxane structure contained in the resin A is simply increased, the durability and the low-temperature fixability are degraded. Hence, as the conditions which satisfy the above two requirements, the present inventors considered a gradient structure in which the concentration of the component suppressing the bleeding is high in the vicinity of the surface layer and is decreased from the surface layer to the center of the toner particle. In addition, it is believed that since the gradient structure is provided so as to satisfy the above formula (1), the degradation in durability and low-temperature fixability is suppressed, and even by a small amount of the resin A, the bleeding can be sufficiently suppressed.

The above $Si^0$, $Si^1$, $Si^2$, are $Si^3$ are normalized assuming that the maximum value of the count amounts of Si at the four points from $P^0$ to $P^3$ obtained by the line analysis using EDS is 100 and is represented by the intensity count which is the relative value thereof. In the line analysis of the toner particle, when the intensity count of Si atoms does not satisfy the above formula (1), it indicates that the gradient structure suppressing the bleeding is not formed in the surface layer region R, and hence, a sufficient effect may not be obtained. In addition, when at least one of $Si^0$, $Si^1$, and $Si^2$ other than $Si^3$ is 0, a stable gradient structure also may not be formed in the surface layer region R, and hence, the effect of suppressing the bleeding may not be obtained. In the above formula (1), $Si^3$ may be 0 but is more preferably more than 0.

Furthermore, the intensity counts of Si atoms, $Si^0$, $Si^1$, $Si^2$, and $Si^3$, preferably satisfy the following formula (4). Since the difference in intensity count of Si atoms between adjacent two points satisfies the following formula (4), a more stable gradient structure may be formed in the surface layer region R, and the bleeding can be further suppressed.

$$Si^0 - Si^1 \geq Si^1 - Si^2 \geq Si^2 - Si^3 \quad (4)$$

As a method to form the gradient structure as described above, for example, the following dissolution suspension method using a hydrophobic dispersion medium may be mentioned. In the dissolution suspension method, after liquid droplets in which the resin A is dissolved in an organic solvent together with the binder resin are dispersed in the hydrophobic dispersion medium, by the use of the difference in affinity to the hydrophobic dispersion medium, the resin A is localized in the vicinity of the surface layer of the liquid droplet, so that the gradient structure may be formed.

The resin A is preferably a polymer of a monomer composition containing a compound X represented by the following formula (II). The compound X is a monomer having an organic polysiloxane structure in its molecular structure and a vinyl group. By the use of this compound X, the resin A may be easily synthesized.

(II)

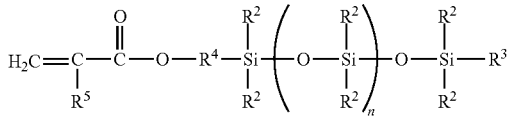

$R^2$ and $R^3$ each represent an alkyl group, $R^4$ represents an alkylene group, and $R^5$ represents a hydrogen atom or a methyl group. In addition, n represents the degree of polymerization and is an integer of 2 or more.

As a synthetic method of the compound X having an organic polysiloxane structure, for example, there may be mentioned a reaction by a de-hydrochloric acid reaction between a carbinol-modified polysiloxane and acrylate chloride or methacrylate chloride.

The content of the resin A in the toner particle is preferably 1.0 to 10.0 percent by mass. When the content of the resin A is set in the range described above, the effect of improving the environmental stability and the low-temperature fixability may be more effectively obtained. When the content of the resin A is 1.0 percent by mass or more, a sufficient amount of Si atoms is present in the surface layer region R. Hence, the effect of suppressing the bleeding is improved, and the environmental stability is further improved. When the content of the resin A is 10.0 percent by mass or less, the amount of the resin A present in the surface layer region R is not excessive and is appropriate. Accordingly, the low-temperature fixability is improved. The content of the resin A is more preferably 3.0 to 7.0 percent by mass.

The toner particle preferably has a surface layer derived from resin fine particles containing a resin B having an organic polysiloxane structure. In particular, in manufacturing of a toner using a dissolution suspension method, when the resin fine particles containing a resin B is used as a dispersing agent, the particle diameter and the particle size distribution may be easily controlled. Furthermore, since the resin fine particles containing a resin B maintains the state of covering the surface of the toner after the manufacturing thereof, the amount of Si atoms in the surface layer of the toner particle may be easily controlled in the range described above.

A solubility parameter SP(A) of the resin A, a solubility parameter SP(B) of the resin B, and a solubility parameter SP(C) of the binder resin preferably satisfy the following formulas (2) and (3).

$$SP(B)<SP(A)<SP(C) \quad (2)$$

$$1.0 \leq SP(C)-SP(A) \leq 4.0 \quad (3)$$

Since the solubility parameters (SP values) of the resin A, the resin B, and the binder resin simultaneously satisfy the above formulas (2) and (3), the low molecular weight components in the wax and/or the binder resin may be more effectively suppressed from bleeding. The SP value is a numerical value used as an index of the solubility or the affinity which indicates the degree of dissolution of a certain substance in another substance. Substances having SP values close to each other have a high solubility or affinity, and substances having SP values apart from each other have a low solubility or affinity. The SP value may be calculated using a solubility parameter calculation software (Hansen Solubility Parameters in Practice: HSPiP 4th Edition 4.1.03).

In the formula (2), when SP(A)<SP(C) holds, the resin A is likely to be localized in the surface layer of the toner, and the gradient structure suppressing the bleeding described above may be easily formed. In addition, when SP(B)<SP(A) holds, a preferable gradient structure of Si atoms is formed in the toner particle, and the above bleeding is suppressed, so that the environmental stability is improved.

Furthermore, when the SP values of the resin A and the binder resin satisfy the above formula (3), the resin A is likely to form the gradient structure described above in the vicinity of the surface of the binder resin. Accordingly, the bleeding of the low molecular weight components in the wax and/or the binder resin, which occurs when the toner particle is left for a long period of time in a severer temperature/humidity environment, may be suppressed. When SP(C)−SP(A) is 1.0 or more, the compatibility of the resin A to the binder resin is degraded, a layer having the change in intensity of Si atoms is formed, so that the bleeding described above can be further suppressed. When SP(C)−SP(A) is 4.0 or less, an excessive phase separation between the resin A and the binder resin is suppressed, and the suppression of the bleeding described above may be preferably maintained. SP(C)−SP(A) is more preferably 2.0 to 3.5.

The resin B is preferably a polymer of a monomer composition containing a compound represented by the following formula (III).

(III)

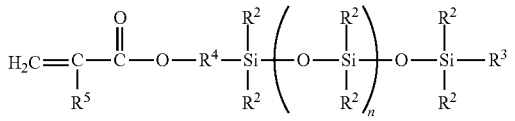

In the formula, $R^2$ and $R^3$ each represent an alkyl group, $R^4$ represents an alkylene group, and $R^5$ represents a hydrogen atom or a methyl group. In addition, n represents the degree of polymerization and is an integer of 2 or more.

The compound represented by the above formula (III) is a monomer having an organic polysiloxane structure in its molecular structure and a vinyl group. By the use of this compound, the resin B may be easily synthesized.

The content of the resin B in the toner particle is preferably 1.0 to 10.0 percent by mass and more preferably 3.0 to 10.0 percent by mass. When the content of the resin B is set in the range described above, the effect of improving the environmental stability and the durability is more effectively obtained. When the content of the resin B is 1.0 percent by mass or more, the effect of improving the environmental stability and the durability is obtained. In addition, when the content of the resin B is 10.0 percent by mass or less, the low-temperature fixability is improved. The content of the resin B is more preferably 4.0 to 7.0 percent by mass.

The resin A preferably contains 90.0 percent by mass or more of a soluble component to an organic solvent. When the soluble component is 90.0 percent by mass or more, the affinity to the hydrophobic dispersion medium becomes preferable, and the gradient structure is more likely to be formed. The soluble component of the resin A to the organic solvent is more preferably 95.0 percent by mass or more.

The resin B preferably contains 30.0 percent by mass or less of a soluble component to the organic solvent. In a dissolution suspension method using the above hydrophobic dispersion medium, since solid resin fine particles containing the resin B is used as the dispersing agent, the particle diameter and the particle size distribution are controlled. When the soluble component is 30.0 percent by mass or less, the particle diameter and the particle size distribution of the toner particles may be sharply controlled. The soluble component of the resin B to the organic solvent is more preferably 15.0 percent by mass or less.

As an organic solvent which controls the above rates of the soluble components of the resin A and the resin B to the organic solvent, for example, there may be mentioned a ketone-based organic solvent, such as acetone, methyl ethyl ketone, methyl isobutyl ketone, or di-n-butyl ketone; an ester-based organic solvent, such as ethyl acetate, butyl acetate, or methoxybutyl acetate; an ether-based organic solvent, such as tetrahydrofuran, diethyl ether, dioxane, ethyl cellosolve, or butyl cellosolve; an amide-based solvent, such as dimethylformamide or dimethylacetamide; an organic hydrocarbon-based organic solvent, such as toluene, xylene, or ethylbenzene; and an aromatic alcohol-based organic solvent, such as 2-phenylethanol. Among the organic solvents mentioned above, toluene, ethyl acetate, methyl ethyl ketone, tetrahydrofuran, acetone, and 2-phenylethanol are preferable.

A method for manufacturing a toner preferably comprises:

a) a step of preparing a resin solution containing a binder resin, a colorant, a wax, a resin A having an organic polysiloxane structure, and an organic solvent;

B) a step of mixing the resin solution, resin fine particles containing a resin B having an organic polysiloxane structure, and carbon dioxide to form liquid droplets of the resin solution covered with the resin fine particles; and c) a step of removing the organic solvent contained in the liquid droplets to form toner particles having surface layers derived from the resin fine particles.

The carbon dioxide is preferably carbon dioxide in a high pressure state and is in particular, carbon dioxide at a pressure of 1.5 MPa or more. In addition, the carbon dioxide in a liquid form or in a supercritical state may be used alone as a dispersion medium, and as another component, an organic solvent may also be contained. In the case described above, the carbon dioxide in a high pressure state and the organic solvent preferably form a uniform phase.

Hereinafter, the above steps a) to c) will be described in detail.

First, in the step a), the binder resin, the colorant, the wax, and the resin A having an organic polysiloxane structure are added to the organic solvent together with other additives if needed. In addition, by a dispersing machine, such as a homogenizer, a ball mill, a colloid mill, or an ultrasonic disperser, the above materials are uniformly dissolved or dispersed. As a result, the above resin solution is prepared.

Next, in the step b), the resin solution thus obtained and carbon dioxide in a high pressure state are mixed together to form liquid droplets of the resin solution. In this case, in a dispersion medium containing the carbon dioxide in a high pressure state, a dispersing agent is required to be dispersed. As the dispersing agent, resin fine particles are preferable, and in particular, resin fine particles containing a resin B are more preferable.

The number average particle diameter of the resin fine particles to be used as the dispersing agent is preferably 30 to 300 nm and more preferably 50 to 200 nm. When the number average particle diameter is in a range of 30 to 300 nm, a sufficient stability of the liquid droplets can be obtained during the formation thereof, and the liquid droplets can be easily controlled to have a desired diameter. In addition, the addition amount of the resin fine particles is preferably 3.0 to 15.0 percent by mass with respect to a solid component amount in the resin solution to be used for the formation of the liquid droplets and may be appropriately adjusted in accordance with the stability and/or the desired diameter of the liquid droplets.

In addition, a dispersion stabilizer in a liquid form may also be added. As the dispersion stabilizer, for example, a compound containing an organic polysiloxane structure or fluorine, each of which has a high affinity to carbon dioxide, and various types of surfactants, such as a nonionic surfactant, an anionic surfactant, and a cationic surfactant, may be mentioned. Those dispersion stabilizers are discharged out of the system together with carbon dioxide in a solvent removing step which will be described later. Hence, the amount of the dispersion stabilizer remaining in the toner particle is significantly small.

As a method to disperse the dispersing agent in a dispersion medium containing carbon dioxide in a high pressure state, any methods may be used. For example, there may be mentioned a method in which a dispersing agent and a dispersion medium containing carbon dioxide in a high pressure state are charged into a container, and direct dispersing is performed by a stirring and/or ultrasonic wave irradiation. In addition, as another method, there may be mentioned a method in which a dispersion liquid in which a dispersing agent is dispersed in an organic solvent is charged using a high pressure pump into a container which receives a dispersion medium containing carbon dioxide in a high pressure state.

In addition, as a method to disperse the resin solution in a dispersion medium containing carbon dioxide in a high pressure state, any methods may be used. For example, there may be mentioned a method in which into a container receiving a dispersion medium which contains carbon dioxide in a high pressure state and a dispersing agent dispersed therein, the resin solution is charged using a high pressure pump. Alternatively, as another method, for example, there may be mentioned a method in which into a container receiving the resin solution, a dispersion medium containing carbon dioxide in a high pressure state and a dispersing agent dispersed therein are charged.

The dispersion medium containing carbon dioxide in a high pressure state is preferably a single phase. When the liquid droplets are formed by dispersing the resin solution in carbon dioxide in a high pressure state, the organic solvent in the liquid droplet is partially transferred into the dispersion medium. In this case, when the phase of the carbon dioxide and the phase of the organic solvent are separately present, the stability of the liquid droplet may be unfavorably degraded thereby. Hence, the temperature and the pressure of the dispersion medium and the amount of the resin solution with respect to that of the carbon dioxide in a high pressure state are preferably adjusted so that the carbon dioxide and the organic solvent are able to form a uniform phase.

In addition, as for the temperature of the dispersion medium, for example, in view of the formability of liquid droplets (degree of easiness in formation of liquid droplets) and the solubility of constituent components in the resin solution to the dispersion medium, the temperature of the dispersion medium is preferably set in a range of 10° C. to 40° C.

In addition, the pressure in the container forming the dispersion medium is, for example, in view of the formability of liquid droplets and the solubility of the constituent components in the resin solution to the dispersion medium, preferably 1.5 to 20.0 MPa and more preferably 2.0 to 15.0 MPa. In addition, when a component other the carbon dioxide is contained in the dispersion medium, the pressure represents the total pressure.

After the formation of the liquid droplets is completed as described above, in the step c), an organic solvent remaining in the liquid droplet is removed by the dispersion medium formed of carbon dioxide in a high pressure state. In particular, carbon dioxide in a high pressure state is further mixed with the dispersion medium in which the liquid droplets are dispersed, and the remaining organic solvent is extracted into the phase of carbon dioxide. Subsequently, carbon dioxide containing this organic solvent is further replaced by carbon dioxide in a high pressure state, so that the organic solvent is removed.

As for the mixing between the dispersion medium and carbon dioxide in a high pressure state, carbon dioxide at a pressure higher than that of the dispersion medium may be added thereto, or the dispersion medium may be added to carbon dioxide at a pressure lower than that thereof.

In addition, as a method in which carbon dioxide containing the organic solvent is further replaced by carbon dioxide in a high pressure state, for example, there may be mentioned a method in which while the pressure in the container is maintained constant, carbon dioxide in a high pressure state is allowed to pass therethrough. In this case, the method described above is performed while toner particles which are formed are trapped by a filter.

When the replacement by carbon dioxide in a high pressure state is not sufficiently performed, and the organic solvent remains in the dispersion medium, the organic solvent dissolved in the dispersion medium is condensed when the pressure of the container is reduced to recover the toner particles thus formed. In addition, problems, such as re-dissolution of the toner particles and bonding therebetween, may arise in some cases. Hence, the replacement by carbon dioxide in a high pressure state is required to be performed until the organic solvent is completely removed. The amount of carbon dioxide in a high pressure state to be allowed to pass is with respect to the volume of the dispersion medium, preferably 1 to 100 times, more preferably 1 to 50 times, and most preferably 1 to 30 times. When the pressure of the container is reduced, and the toner particles are recovered from a dispersion which contains carbon dioxide in a high pressure state and the toner particles dispersed therein, although the pressure may be rapidly decreased to normal pressure at normal temperature, the pressure may be decreased in a stepwise manner using a plurality of containers, the pressures of which are independently controlled, provided in a multistage manner. The rate of decrease in pressure is preferably set so as not to generate air bubbles in the toner particles.

In addition, the organic solvent and carbon dioxide, which are to be used in the manufacturing described above, may be recycled.

Materials to be used for the toner will be described.

In the toner, when the resin A and the resin B are each synthesized using the above vinyl-based monomer (compound X) having an organic polysiloxane structure, as another monomer to be used, a general monomer having a vinyl group may be used. Hereinafter, although materials which may be used will be described by way of example, the materials are not limited to those shown below.

There may be mentioned aliphatic vinyl hydrocarbons: alkenes, such as ethylene, propylene, butene, isobutylene, pentene, heptene, diisobutylene, octene, dodecene, octadecene, and other α-olefins; alkadienes, such as butadiene, isoprene, 1,4-pentadiene, 1,6-hexadiene, and 1,7-octadiene; alicyclic vinyl hydrocarbons: mono- or di-cycloalkenes and alkadienes, such as cyclohexene, cyclopentadiene, vinylcyclohexene, and ethylidenebicycloheptene; terpenes, such as pinene, limonene, and indene;

aromatic vinyl hydrocarbons: styrene and hydrocarbyl (alkyl, cycloalkyl, aralkyl and/or alkenyl) substituted products thereof, such as α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene, trivinylbenzene, and vinylnaphthalene; carboxyl group-containing vinyl monomers and metal salts thereof: unsaturated monocarboxylic acids and unsaturated dicarboxylic acids, each of which has 3 to 30 carbon atoms, and anhydrides and monoalkyl (having 1 to 27 carbon atoms) esters thereof, such as acrylic acid, methacrylic acid, maleic acid, maleic anhydride, a monoalkyl ester of maleic acid, fumaric acid, a monoalkyl ester of fumaric acid, crotonic acid, itaconic acid, a monoalkyl ester of itaconic acid, a glycol monoether of itaconic acid, citraconic acid, a monoalkyl ester of citraconic acid, and cinnamic acid: vinyl esters, such as vinyl acetate, vinyl butyrate, vinyl propionate, vinyl butyrate, diallyl phthalate, diallyl adipate, isopropenyl acetate, vinyl methacrylate, methyl-4-vinylbenzoate, cyclohexyl methacrylate, benzyl methacrylate, phenyl acrylate, phenyl methacrylate, vinyl methoxy acetate, vinyl benzoate, ethyl α-ethoxy acrylate, an alkyl acrylate and an alkyl methacrylate, each having an alkyl group (linear or branched) with 1 to 11 carbon atoms (such as methyl acrylate, methyl methacrylate, ethyl acrylate, ethyl methacrylate, propyl acrylate, propyl methacrylate, butyl acrylate, butyl methacrylate, 2-ethylhexyl acrylate, and 2-ethylhexyl methacrylate); a dialkyl fumarate (a fumaric acid dialkyl ester) (two alkyl groups are linear, branched, or alicyclic groups each having 2 to 8 carbon atoms), a dialkyl maleate (a maleic acid dialkyl ester) (two alkyl groups are linear, branched, or alicyclic groups each having 2 to 8 carbon atoms); polyallyloxyalkanes (diallyloxyethane, triallyloxyethane, tetraallyloxyethane, tetraalloykoxypropane, tetraallyloxybutane, and tetramethaallyloxyethane); vinyl-based monomers each having a polyalkylene glycol chain (polyethylene glycol (molecular weight: 300) monoacrylate, polyethylene glycol (molecular weight: 300) monomethacrylate, polypropylene glycol (molecular weight: 500) monoacrylate, polypropylene glycol (molecular weight: 500) monomethacrylate, methoxy-polyethylene glycol acrylate, methoxy-polypropylene glycol acrylate, ethoxy-polyethylene glycol acrylate, methyl alcohol ethylene oxide (hereinafter, ethylene oxide is abbreviated as EO) 10-mol adduct acrylate, methyl alcohol ethylene oxide (hereinafter, ethylene oxide is abbreviated as EO) 10-mol adduct methacrylate, lauryl alcohol EO 30-mol adduct acrylate, and lauryl alcohol EO 30-mol adduct methacrylate); and polyacrylates and polymethacrylates (polyacrylates and polymethacrylates of polyalcohols), such as ethylene glycol diacrylate, ethylene glycol dimethacrylate, propylene glycol diacrylate, propylene glycol dimethacrylate, neopentyl glycol diacrylate, neopentyl glycol dimethacrylate, trimethylolpropane triacrylate, trimethylolpropane trimethacrylate, polyethylene glycol diacrylate, and polyethylene glycol dimethacrylate.

As the other vinyl monomers to be used for the synthesis of the above resin B, a vinyl-based monomer into which a polyester is introduced may also be used. Although a method for introducing a polyester is not particularly limited, from an industrial point of view, a polyester having a polymerizable unsaturated group is preferably introduced during polymerization.

As a method for manufacturing a polyester having a polymerizable unsaturated group, the following methods may be mentioned.

As a method (1) in which in a polycondensation reaction between a dicarboxylic acid and a diol, a polymerizable unsaturated group is introduced, the following methods may be mentioned:

(1-1) a method in which a dicarboxylic acid having a polymerizable unsaturated group as a part thereof is used;

(1-2) a method in which a diol having a polymerizable unsaturated group as a part thereof is used; and (1-3) a method in which a dicarboxylic acid having a polymerizable unsaturated group as a part thereof and a diol having a polymerizable unsaturated group as a part thereof are used.

The degree of unsaturation of the polyester having a polymerizable unsaturated group may be adjusted by the addition amount of the dicarboxylic acid or the diol, each of which has a polymerizable unsaturated group.

As the dicarboxylic acid having a polymerizable unsaturated group, for example, fumaric acid, maleic acid, 3-hexenedioic acid, and 3-octenedioic acid may be mentioned. In addition, a lower alkyl ester and an anhydride thereof may also be mentioned. Among those mentioned above, in view of cost, fumaric acid and maleic acid are more preferable. In addition, as an aliphatic diol having a polymerizable unsaturated group, for example, 2-buten-1,4-diol, 3-hexene-1,6-diol, and 4-octene-1,8-diol may be mentioned.

As a dicarboxylic acid and a diol, each of which has no polymerizable unsaturated group, there may be used a dicarboxylic acid and a diol which are to be used for manufacturing of a general polyester which will be described later.

In a method (2) in which a polyester formed by polycondensation between a dicarboxylic acid and a diol is coupled with a vinyl-based compound, for this coupling, a vinyl-based compound having a functional group capable of reacting with a terminal functional group of a polyester may be directly coupled therewith. In addition, after at least one terminal of a polyester is modified using a binding agent so as to be able to react with a functional group of a vinyl-based compound, the coupling may be performed therebetween. As the method (2) described above, for example, the following methods may be mentioned.

(2-1) A method in which a polyester having a carboxyl group at its terminal and a vinyl-based compound having a hydroxyl group are coupled by a polycondensation reaction. In the method described above, for the preparation of the polyester, the molar ratio (dicarboxylic acid/diol) of the dicarboxylic acid to the diol is preferably set to 1.02 to 1.20.

(2-2) A method in which a polyester having a hydroxyl group at its terminal and a vinyl-based compound having an isocyanate group are coupled by a urethane formation reaction.

(2-3) A method in which a polyester having a hydroxyl group at its terminal and a vinyl-based compound having hydroxyl group are coupled by a urethane formation reaction using a diisocyanate functioning as a binding agent.

In the methods (2-2) and (2-3) described above, for the preparation of the polyester, the molar ratio (diol/dicarboxylic acid) of the diol to the dicarboxylic acid is preferably set to 1.02 to 1.20.

As the vinyl-based compound having a hydroxyl group, for example, there may be mentioned hydroxystyrene, N-methylol acrylamide, N-methylol methacrylamide, hydroxyethyl acrylate, hydroxyethyl methacrylate, hydroxypropyl acrylate, hydroxypropyl methacrylate, polyethylene glycol monoacrylate, polyethylene glycol monomethacrylate, allyl alcohol, methallyl alcohol, crotyl alcohol, isocrotyl alcohol, 1-buten-3-ol, 2-buten-1-ol, 2-buten-1,4-diol, propargyl alcohol, 2-hydroxyethylpropenyl ether, and sucrose allyl ether. Among those compounds mentioned above, hydroxy ethyl acrylate and hydroxy ethyl methacrylate are preferable.

As the vinyl-based compound having an isocyanate group, for example, there may be mentioned 2-isocyanatoethyl acrylate, 2-isocyanatoethyl methacrylate, methacrylic acid 2-(0-[1'-methylpropylideneamino]carboxyamino)ethyl, 2-[(3,5-dimethylpyrazolyl)carbonylamino]ethyl methacrylate, and m-isopropenyl-α,α-dimethylbenzyl isocyanate. Among those compounds mentioned above, 2-isocyanatoethyl acrylate and 2-isocyanatoethyl methacrylate are particularly preferable.

As the diisocyanate, for example, there may be mentioned aromatic diisocyanates each having 6 to 20 carbon atoms (excluding carbon atoms in the NCO groups, and hereinafter, the number of carbon atoms is calculated in the same manner as described above), aliphatic diisocyanates each having 2 to 18 carbon atoms, alicyclic diisocyanates each having 4 to 15 carbon atoms, and modified products of those diisocyanates (such as modified products containing a urethane group, a carbodiimide group, an allophanate group, a urea group, a biuret group, a uretdione group, a urethoimine group, an isocyanurate group, and an oxazolidone group). Hereinafter, those modified products are referred to as modified diisocyanates in some cases.

As the aromatic diisocyanates, for example, m- and/or p-xylylene diisocyanate (XDI) and α,α,α',α'-tetramethylxylylene diisocyanate may be mentioned. As the aliphatic diisocyanates, for example, there may be mentioned ethylene diisocyanate, tetramethylene diisocyanate, hexamethylene diisocyanate (HDI), and dodecamethylene diisocyanate. As the alicyclic diisocyanates, for example, there may be mentioned isophorone diisocyanate (IPDI), dicyclohexylmethane-4,4'-diisocyanate, cyclohexylene diisocyanate, and methylcyclohexylene diisocyanate. Among those diisocyanates mentioned above, XDI, HDI, and IPDI are preferable.

As the polyester having a polymerizable unsaturated group, either a crystalline polyester or an amorphous polyester may be used. The crystallinity indicates the characteristics in which a clear melting point peak is observed in a differential scanning calorimetry, and softening hardly occurs at a temperature lower than the melting point and rapidly occurs at a temperature higher than that by melting.

As the polyester having a polymerizable unsaturated group, a crystalline polyester is preferably used, and when being used as the toner, this polyester is able to simultaneously satisfy the low-temperature fixability and a severe-environment storage property. The crystalline polyester having a polymerizable unsaturated group may be synthesized using a linear aliphatic diol having 2 to 20 carbon atoms and a linear aliphatic dicarboxylic acid having 2 to 20 carbon atoms. As the linear aliphatic diol having 2 to 20 carbon atoms and the linear aliphatic dicarboxylic acid having 2 to 20 carbon atoms, there may be mentioned compounds similar to an aliphatic diol having 2 to 20 carbon atoms and an aliphatic dicarboxylic acid having 2 to 20 carbon atoms, each of which is to be used for manufacturing of a crystalline polyester for the binder resin which will be described later.

The resin B may further have a cross-linked structure. For the introduction of a cross-linked structure, for example, an introduction method using a crystalline polyester having a polymerizable unsaturated group and an introduction method using at least one of the following polyfunctional monomers may be used alone or in combination.

When the cross-linked structure is introduced using a polyfunctional monomer, a vinyl-based polyfunctional monomer is preferable. The polyfunctional polymer is a monomer having at least two polymerizable functional groups. As the vinyl-based polyfunctional monomers, for example, there may be mentioned difunctional monomers, such as polyethylene glycol diacrylate, polypropylene glycol diacrylate, polytetramethylene glycol diacrylate, 1,6-hexanediol diacrylate, neopentyl glycol diacrylate, polyethylene glycol dimethacrylate, polypropylene glycol dimethacrylate, polytetramethylene glycol dimethacrylate, 1,6-hexanediol dimethacrylate, neopentyl glycol dimethacrylate, divinylbenzene, divinylnaphthalene, a both-terminal acrylic modified silicone, and a both-terminal methacrylic modified silicone; trifunctional monomers, such as trimethylolpropane triacrylate and trimethylolpropane trimethacrylate; and tetrafunctional monomers, such as tetramethylolmethane tetraacrylate and tetramethylolmethane tetramethacrylate.

As the binder resin, either an amorphous resin or a crystalline resin, each of which is generally used for the toner, may be used.

The amorphous resin is a resin showing no clear melting point peak in a differential scanning calorimetry. However, the glass transition temperature (Tg) of the amorphous resin is preferably in a range of 50° C. to 130° C. and more preferably in a range of 50° C. to 100° C. Since containing the amorphous resin, the toner particles are likely to maintain the elasticity after being fixed. As particular examples of the amorphous resin, for example, an amorphous polyester resin, an amorphous vinyl resin, and an amorphous urethane resin may be mentioned. In addition, those resins each may be modified, for example, by a urethane, a urea, or an epoxy.

As monomers usable for manufacturing of the amorphous polyester resin, for example, a known divalent or trivalent carboxylic acid and a known divalent or trivalent alcohol may be mentioned. As particular examples of those monomers, the following materials may be mentioned. As the divalent carboxylic acid, for example, there may be mentioned dibasic acids, such as succinic acid, adipic acid, sebacic acid, phthalic acid, isophthalic acid, terephthalic acid, malonic acid, and dodecenyl succinic acid; anhydrides or lower alkyl esters of those mentioned above; and aliphatic unsaturated dicarboxylic acids, such as maleic acid, fumaric acid, itaconic acid, and citraconic acid. In addition, as the trivalent carboxylic acids, for example, there may be mentioned 1,2,4-benzene tricarboxylic acid, 1,2,5-benzen tricarboxylic acid, and anhydrides or lower alkyl esters thereof. Those monomers may be used alone, or at least two types thereof may be used in combination.

As the divalent alcohols, for example, there may be mentioned alkylene glycols (ethylene glycol, 1,2-propylene glycol, and 1,3-propylene glycol); alkylene ether glycols (polyethylene glycol and polypropylene glycol), alicyclic diols (1,4-cyclohexanedimethanol); alicyclic diols (1,4-cyclohexanedimethanol); bisphenols (bisphenol A); and alkylene oxide (ethylene oxide and propylene oxide) adducts of alicyclic diols. The alkyl portions of the alkylene glycol and the alkylene ether glycol may be either linear or branched. In addition, as the trivalent alcohols, for example, there may be mentioned glycerin, trimethylolethane, trimethylolpropane, and pentaerythritol. Those alcohols may be used alone, or at least two types thereof may be used in combination.

In addition, in order to adjust the acid value and the hydroxyl value, if needed, a monovalent carboxylic acid, such as acetic acid or benzoic acid, and a monovalent alcohol, such as cyclohexanol or benzyl alcohol, may also be used.

Although a method for synthesizing an amorphous polyester resin is not particularly limited, for example, an ester exchange method and a direct polycondensation method may be used alone or in combination.

Next, the amorphous vinyl resin will be described. As monomers usable for manufacturing of the amorphous vinyl resin, for example, there may be mentioned monomers similar to the monomers each having a vinyl group which are used for the synthesis of the resin A and the resin B described above.

Next, the amorphous polyurethane resin will be described. A polyurethane resin is a reaction product between a diol and a compound having a diisocyanate group, and when the diol and the compound having a diisocyanate group are appropriately selected, resins having various functions may be obtained. As the compounds having a diisocyanate group, for example, there may be used compounds similar to the diisocyanates which are used for manufacturing of the polyester having a polymerizable unsaturated group used for the synthesis of the resin B described above.

As a diol usable for the amorphous polyurethane resin, a diol similar to the above divalent alcohol usable for the amorphous polyester may be used.

As the crystalline resin, for example, a crystalline polyester, a crystalline vinyl resin, a crystalline polyurethane, and a crystalline polyurea may be mentioned. Among those mentioned above, the crystalline polyester resin and the crystalline vinyl resin are preferable. The melting point of the crystalline resin is preferably 50° C. to 90° C.

As the crystalline polyester, a resin obtained by a reaction between an aliphatic diol and an aliphatic dicarboxylic acid is preferable, and a resin obtained by a reaction between an aliphatic diol having 2 to 20 carbon atoms and an aliphatic dicarboxylic acid having 2 to 20 carbon atoms is more preferable. In addition, the aliphatic diol and the aliphatic dicarboxylic acid each preferably have a linear structure. Since the aliphatic diol and the aliphatic dicarboxylic each have a linear structure, a polyester having a higher crystallinity may be obtained.

As the linear aliphatic diol having 2 to 20 carbon atoms, for example, there may be mentioned 1,2-ethanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18 octadecanediol, and 1,20-icosanediol. Among those diols mentioned above, in view of the melting point, 1,4-butanediol, 1,5-pentanediol, 1,6-hexanediol, 1,7-heptanediol, 1,8-octanediol, 1,9-nonanediol, and 1,10-decanediol are more preferable. Those diols mentioned above may be used alone, or at least two types thereof may be used by mixing.

In addition, an aliphatic diol having a double bond may also be used. As the aliphatic diol having a double bond, for example, there may be mentioned 2-butene-1,4-diol, 3-hexene-1,6-diol, and 4-octene-1,8-diol.

As the linear aliphatic dicarboxylic acid having 2 to 20 carbon atoms, for example, there may be mentioned oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tirdecanedicarboxylic acid, 1,14-tetradecanedicarboxylic acid, 1,16-hexadecanedicarboxylic acid, and 1,18-octadecanedicarboxylic acid. Lower alkyl esters and anhydrides of those aliphatic dicarboxylic acids mentioned above may also be used. Among those dicarboxylic acids mentioned above, sebacic acid, adipic acid, and 1,10-decanedicarboxylic acid, and lower alkyl ester and anhydrides thereof are preferably used. Those dicarboxylic acids may be used alone, or at least two types thereof may be used by mixing.

In addition, an aromatic dicarboxylic acid may also be used. As the aromatic dicarboxylic acid, for example, there may be mentioned terephthalic acid, isophthalic acid, 2,6-naphthalene dicarboxylic acid, and 4,4'-biphenyldicarbonxylic acid. Among those mentioned above, since being easily available and easily formed into a low melting-point polymer, terephthalic acid is preferable.

A method for manufacturing a crystalline polyester is not particularly limited, and by a general polyester polymerization method in which a dicarboxylic acid component and a diol component are allowed to react with each other, the crystalline polyester may be manufactured. For example, depending on the types of monomers to be used, the crystalline polyester may be manufactured by a direct polycondensation method or an ester exchange method. The manufacturing of the crystalline polyester is preferably performed at a polymerization temperature of 180° C. to 230° C., and if needed, while water and/or an alcohol generated during the condensation is removed by reducing the pressure in the reaction system, the reaction is preferably performed.

As a catalyst usable for manufacturing of the crystalline polyester, for example, there may be mentioned a titanium catalyst, such as titanium tetraethoxide, titanium tetrapropoxide, titanium tetraisopropoxide, or titanium tetrabutoxide, or a tin catalyst, such as dibutyl tin chloride, dibutyl tin oxide, or diphenyl tin oxide.

As the crystalline vinyl resin, for example, a resin obtained by polymerization of a vinyl monomer containing a linear alkyl group in its molecular structure may be mentioned.

As the vinyl monomer containing a linear alkyl group in its molecular structure, for example, an alkyl acrylate or an alkyl methacrylate, the alkyl group of which has 12 carbon atoms or more, is preferable. In particular, for example, there may be mentioned lauryl acrylate, lauryl methacrylate, myristyl acrylate, myristyl methacrylate, cetyl acrylate, cetyl methacrylate, stearyl acrylate, stearyl methacrylate, eicosyl acrylate, eicosyl methacrylate, behenyl acrylate, or behenyl methacrylate.

In a manufacturing method of the crystalline vinyl resin, polymerization is performed at a temperature of 40° C. or more and, in general, preferably at a temperature of 50° C. to 90° C.

The toner particles contain a wax. Although the wax is not particularly limited, for example, there may be mentioned an aliphatic hydrocarbon wax, such as a low-molecular weight polyethylene, a low-molecular weight polypropylene, a low-molecular weight olefin copolymer, a microcrystalline wax, a paraffin wax, or a Fischer-Tropsch wax; an oxide of an aliphatic hydrocarbon wax, such as an oxidized polyethylene wax; a wax, such as an aliphatic hydrocarbon ester wax, containing as a primary component, a fatty acid ester; a wax, such as a deoxidized carnauba wax, in which a fatty acid ester is partially or fully deoxidized; a partially esterified wax, such as behenic acid monoglyceride, formed from a fatty acid and a polyalcohol; or a methyl ester compound having a hydroxyl group which is obtained by hydrogen addition to a vegetable oil. As a wax preferably used for the toner particles, an aliphatic hydrocarbon wax and an ester wax are mentioned. As the ester wax, an ester between a carboxylic acid having trivalent or more and an aliphatic monoalcohol or an ester between an alcohol having trivalent or more and an aliphatic monocarboxylic acid is preferable. As the alcohol having trivalent or more, for example, there may be mentioned glycerin, trimethylolpropane, erythritol, pentaerythritol, sorbitol, diglycerin, triglycerin, tetraglycerin, hexaglycerin, decaglycerin, ditrimethylolpropane, trismethylolpropane, dipentaerythritol, or trispentaerythritol. Among those mentioned above, an alcohol having a branched structure is preferable, and pentaerythritol or dipentaerythritol is more preferable. As the carboxylic acid having trivalent or more, for example, there may be mentioned trimellitic acid or butane tetracarboxylic acid.

As the aliphatic monocarboxylic acid, for example, there may be mentioned caproic acid, caprylic acid, octyl acid, nonyl acid, decanoic acid, dodecanoic acid, lauric acid, tridecanoic acid, myristic acid, palmitic acid, stearic acid, or behenic acid. In view of the melting point of the wax, myristic acid, palmitic acid, stearic acid, and behenic acid are preferable. As the aliphatic monoalcohol, for example, there may be mentioned caprylic alcohol, lauryl alcohol, myristyl alcohol, palmityl alcohol, stearyl alcohol, or behenyl alcohol. In view of the melting point of the wax, myristyl alcohol, palmityl alcohol, stearyl alcohol, and behenyl alcohol are preferable.

The addition amount of the wax in the toner is with respect to 100 parts by mass of the toner particles, preferably 1.0 to 20.0 parts by mass and more preferably 2.0 to 15.0 parts by mass. When the addition amount is in the range described above, a release property of the toner can be sufficiently obtained, and the severe-environment storage property is also improved.

The wax preferably has a maximum endothermic peak at 60° C. to 120° C. by measurement using a differential scanning calorimeter (DSC) and more preferably has a maximum endothermic peak at 60° C. to 90° C.

The toner particles contain a colorant, and as a colorant which is preferably used, for example, an organic pigment, an organic dye, an inorganic pigment, carbon black functioning as a black colorant, and magnetic particles may be mentioned. Besides those colorants mentioned above, a colorant which has been used for related toners may also be used.

As a yellow colorant, for example, there may be mentioned a condensed azo compound, an isoindoline compound, an anthraquinone compound, an azo metal complex, a methine compound, or an allylamide compound. In particular, C.I. Pigment Yellow 12, 13, 14, 15, 17, 62, 74, 83, 93, 94, 95, 109, 110, 111, 128, 129, 147, 155, 168, or 180 is preferably used.

As a magenta colorant, for example, there may be mentioned a condensed azo compound, a diketopyrrolopyrrole compound, an anthraquinone compound, a quinacridone compound, a basic dye lake compound, a naphthol compound, a benzimidazolone compound, a thioindigo compound, or a perylene compound. In particular, C.I. Pigment Red 2, 3, 5, 6, 7, 23, 48: 2, 48: 3, 48: 4, 57: 1, 81: 1, 122, 144, 146, 166, 169, 177, 184, 185, 202, 206, 220, 221, or 254 is preferably used.

As a cyan colorant, for example, there may be mentioned a copper phthalocyanine compound or its derivative, an anthraquinone compound, or a basic dye lake compound. In particular, C.I. Pigment Blue 1, 7, 15, 15: 1, 15: 2, 15: 3, 15: 4, 60, 62, or 66 is preferably used.

Those colorants mentioned above may be used alone or in combination by mixing and may also be used in a solid solution state. The colorants to be used for the toner particles are each selected in view of the hue angle, color saturation, lightness value, light resistance, OHP transparency, and dispersibility in the toner.

With respect to 100 parts by mass of the toner particles, 1.0 to 20.0 parts by mass of the colorant is preferably added. When carbon black is used as the black colorant, as is the case described above, the addition amount thereof is preferably 1.0 to 20.0 parts by mass with respect to 100 parts by mass of the toner particles.

In the toner particles, if needed, a charge control agent may be contained. In addition, the charge control agent may be externally added to the toner particles. When the charge control agent is contained, the optimum triboelectric charge quantity can be controlled in accordance with a development system.

As a charge control agent which controls the toner to have a negative charge, an organic metal compound and a chelate compound are effectively used, and for example, there may be mentioned a monoazo metal compound, an acetylacetone metal compound, and metal compounds of an aromatic oxycarboxylic acid, an aromatic dicarboxylic acid, an oxycarboxylic acid and a dicarboxylic acid. As a charge control agent which controls the toner to have a positive charge, for example, there may be mentioned nigrosine, a quaternary ammonium salt, a metal salt of a higher fatty acid, a diorganotin borate, a guanidine compound, and an imidazole compound.

The content of the charge control agent is with respect to 100 parts by mass of the toner particles, preferably 0.01 to 20.0 percent by mass and more preferably 0.5 to 10.0 parts by mass.

To the toner particles, inorganic fine particles are preferably added as a fluidity improver. As the inorganic fine particles, for example, silica fine particles, titanium oxide fine particles, alumina fine particles, or composite oxide fine particles thereof may be mentioned. Among the inorganic fine particles, silica fine particles and titanium oxide fine particles are preferable.

As the silica fine particles, for example, dry silica or fumed silica, which is formed by vapor phase oxidation of a silicon halogen compound, and wet silica manufactured from liquid glass may be mentioned. Among those mentioned above, dry silica is preferable since the number of silanol groups present on the surfaces of the silica fine particles and present therein is small, and the number of $Na_2O$ and $SO_3^{2-}$ is small. In addition, the dry silica may be composite fine particles of silica and another metal oxide which are manufactured by using a metal halogen compound, such as aluminum chloride and/or titanium chloride, together with a silicon halogen compound in a manufacturing process.

The inorganic fine particles are preferably externally added to the toner particles for the improvement in fluidity of the toner and the charge uniformization thereof. In addition, since the adjustment of charge amount of the toner, the improvement in environmental stability, and the improvement in characteristics in a high humidity environment can be achieved when a hydrophobic treatment is performed on the inorganic fine particles, inorganic fine particles processed by a hydrophobic treatment are preferably used. When the inorganic fine particles added to the toner absorb moisture, the charge amount of the toner is decreased, and the developability and the transferability are liable to be degraded.

As a treating agent of the hydrophobic treatment for the inorganic fine particles, for example, there may be mentioned non-modified or variously modified silicone vanishes, non-modified or variously modified silicone oils, silane compounds, silane coupling agents, other organic silicone compounds, and other organic titanium compounds may be mentioned. Those treating agents may be used alone or in combination.

Among those mentioned above, inorganic fine particles processed by a silicone oil are preferable, and hydrophobic treated inorganic fine particles are more preferable which are formed in such a way that inorganic fine particles are processed by a hydrophobic treatment using a silane coupling agent, and a treatment using a silicon oil is also performed at the same time or after the above treatment.

The addition amount of the inorganic fine particles is with respect to 100 parts by mass of the toner particles, preferably 0.1 to 4.0 parts by mass and more preferably 0.2 to 3.5 parts by mass.

The weight average particle diameter (D4) of the toner is preferably 3.0 to 8.0 μm and more preferably 5.0 to 7.0 μm. By the use of the toner having the weight average particle diameter (D4) as described above, while the handling property of the toner is improved, the reproducibility of dots is preferably sufficiently satisfied. The ratio (D4/D1) of the weight average particle diameter (D4) of the toner thus obtained to the number average particle diameter (D1) thereof is preferably less than 1.30.

Hereinafter, measurement methods of the various physical properties defined herein will be described.

<Measurement Method of Amount of Si Atoms Derived from Organic Polysiloxane Structure by X-Ray Photoelectron Spectroscopy (XPS)>

The amount (atomic %) of Si atoms of the toner particles is measured by an X-ray photoelectron spectroscopy (XPS) as described below. The XPS apparatus and the measurement conditions are as follows.

Apparatus: Quantum 2000 manufactured by ULVAC-PHI, Inc.

Analysis Method: Narrow Analysis

Measurement Conditions:

X-ray Source: Al-Kα

X-ray Conditions: 100 μm, 25 W, 15 kV

Photoelectron Incident Angle: 45°

Pass Energy: 58.70 eV

Measurement range: 100 μm in diameter

The measurement is performed under the conditions described above, and the peak derived from the C—C bond of the carbon is orbit is corrected to 285 eV. Subsequently, the amount of Si atoms with respect to the total amount of the constituent elements is then calculated from the peak area of the SiO bond of the silicon 2p orbit, the peak top of which is detected at 100 to 103 eV, by using a relative sensitivity factor provided by ULVAC-PHI, Inc. In addition, when another Si 2p orbital peak ($SiO_2$: more than 103 to 105 eV) is detected, the SiO bond peak area is calculated by carrying out waveform separation on the SiO bond peak.

<Calculation of Content of Si Atoms Derived from Organic Polysiloxane Structure in Surface Layer Region R>

The toner is embedded with a visible light-curable embedding resin (D-800, manufactured by Nisshin EM Co., Ltd.) and is cut by an ultrasonic ultramicrotome (EM5, manufactured by Leica) to form a thin sample having a thickness of 60 nm. A cross-section of a toner particle of the sample thus obtained is observed by a transmission electron microscope (JEM2800, manufactured by JEOL), and mapping of Si atoms is performed by EDS (Noran System7, manufactured by Thermo Fisher Scientific K.K.). The mapping conditions are as follows.

Acceleration Voltage: 200 KV

Electron Irradiation Size: 1.5 nm

Identification method of Si atoms: Automatic detection of Si—K line using automatic qualitative function of spectrum Live Time Limit: 600 sec Dead Time: 20 to 30

Mapping Resolution: 256×256

Accordingly, an exclusive area At of Si atoms in a cross-section of one toner particle is obtained.

Next, as shown in FIG. 1, from the minimum diameter ($M_s$) and the maximum diameter ($M_L$) of the toner cross-section, a particle diameter M (μm) of the toner is obtained, and as shown below, a distance m (μm) equivalent to 10.0% of the particle diameter in the cross-section of the toner particle in the surface layer region R is obtained.

$$\text{Toner Particle Diameter } M=(M_s+M_L)\times 1/2$$

$$\text{Distance } m \text{ Equivalent to 10.0\% of Particle Diameter in the cross-section of Toner Particle in Surface Layer Region } R=M(\text{Toner Particle Diameter})\times 1/10$$

In the cross-section of the toner particle, a region other than the surface layer region R from the periphery of the cross-section to the inside at the above distance m (μm) is masked. In addition, an exclusive area Am of Si atoms in the surface layer region R is obtained. The calculation of the exclusive areas At and Am of Si atoms are performed using an image processing software (Photoshop 5.0, manufactured by Adobe). The content of Si atoms derived from an organic polysiloxane structure present in the surface layer region R is obtained as described below.

Content of Si Atoms Derived from Organic Polysiloxane Structure Present in Surface Layer Region $R(\%)=Am/At\times 100$ The measurement described above is performed on arbitrarily selected 50 toner particles, and the arithmetic average of the contents of Si atoms of the 50 toner particles is regarded as the content of Si atoms derived from an organic polysiloxane structure present in the surface layer region R.

<Calculation of Si Intensity by Line Analysis Along Straight Line Between Periphery of Surface Layer Region R and Gravity Center of Cross-Section>

As shown in FIG. 1, the Si intensities of ($Si^0$, $Si^1$, $Si^2$, and $Si^3$) by the line analysis along the straight line between the periphery of the surface layer region R and the gravity center of the cross-section are obtained as described below.

The intersection between the straight line and the periphery of the cross-section and the intersection between the straight line and the boundary line of the surface layer region R are represented by $P^0$ and $P^3$, respectively, and points equally dividing this line segment $P^0P^3$ into three portions are represented by $P^1$ and $P^2$ in this order from the side closer to the intersection $P^0$. In addition, the intensities of Si atoms at $P^0$, $P^1$, $P^2$, and $P^3$ are calculated as the count amount using the above EDS. In this case, the maximum value of Si atoms is assumed as 100, and the count amount is normalized, so that the intensity count thus obtained, which is a relative value, is used. The measurement is performed on arbitrarily selected 50 toner particles, and the arithmetic averages thereof are regarded as the values of $Si^0$, $Si^1$, $Si^2$, and $Si^3$.

<Calculation of Soluble Component Amounts of Resin a and Resin B>

The soluble component amounts of the resin A and the resin B are calculated as described below. The same method is used for the resin A and the resin B.

(1) After 100 mg of a resin sample is measured in a 50-ml centrifugal tube with a lid, and the mass is precisely recorded, 30 g of acetone is charged in the above centrifugal tube.

(2) The centrifugal tube with a lid is maintained in a constant-temperature bath under a temperature condition at 40° C. for 30 minutes, so that the resin sample is dissolved in acetone.

(3) An insoluble component in the centrifugal tube with a lid and acetone containing a soluble component are separated by a centrifugal machine under the following centrifugal conditions.

Centrifugal Machine: H-9R (manufactured by KOKUSAN)
Rotor: $B_{N1}$ rotor (manufactured by KOKUSAN)
Set Temperature of Machine: 30° C.
Number of Rotations: 18,000 rpm
Time: 1.5 hours Subsequently, the soluble component is removed by removing a supernatent, so that the resin sample which is the insoluble component is obtained. In addition, the soluble component amount of the resin sample is obtained as described below.

Soluble component amount of resin sample (%)= (mass of resin sample-mass of resin sample which is insoluble component)/mass of resin sample×100

<Measurement Method of Weight Average Particle Diameter (D4) and Number Average Particle Diameter (D1) of Toner Particles>

The weight average particle diameter (D4) and the number average particle diameter (D1) of the toner particles are calculated as described below. As a measurement device, a precise particle size distribution measurement device "Coulter Counter Multisizer 3" (registered traded name, manufactured by Beckman Coulter Inc.) provided with a 100-μm aperture tube is used in accordance with an aperture impedance method. By an attached dedicated software "Beckman Coulter Multisizer 3 Version 3.51" (manufactured by Beckman Coulter Inc.), the measurement conditions are set, and the analysis of measured data is performed. In addition, as effective measurement channels for the measurement, 25,000 channels are used.

As an aqueous electrolyte solution to be used for the measurement, there may be used a solution, such as "ISOTON II" (manufactured by Beckman Coulter Inc.), in which reagent grade sodium chloride is dissolved in ion-exchanged water to have a concentration of approximately 1 percent by mass.

In addition, before the measurement and the analysis are performed, the above dedicated software is set as described below.

On the "change standard operating method (SOM)" screen of the dedicated software, the total count number in the control mode is set to 50,000 particles, the number of measurements is set to 1, and the value obtained using "10.0 μm standard particles" (manufactured Beckman Coulter, Inc.) is set for the Kd value. The threshold value and noise level are automatically set by pressing the "threshold value/noise level measurement button". In addition, the current is set to 1,600 μA, the gain is set to 2, the electrolyte solution is set to ISOTON II, and the "flush of aperture tube after measurement" is checked.

On the "pulse-to-particle diameter conversion setting" screen of the dedicated software, the bin interval is set to logarithmic particle diameter, the particle diameter bin is set to 256 particle diameter bins, and the particle diameter range is set to from 2 to 60 μm.

The specific measurement method is as described below.

(1) After approximately 200 mL of the above aqueous electrolyte solution is charged into a 250-mL round-bottom glass beaker which is exclusively used for Multisizer 3, this beaker is then set to a sample stand, and counterclockwise stirring is performed with a stirring rod at 24 rotations per second. Subsequently, dirt and bubbles in the aperture tube are removed using the "aperture flush" function of the dedicated software.

(2) Approximately 30 mL of the above aqueous electrolyte solution is charged into a 100-mL flat-bottom glass beaker. To this beaker, as a dispersing agent, approximately 0.3 mL of a diluted solution is added which is obtained by diluting "Contaminon N" by approximately three times the mass of ion-exchanged water. The "Contaminon N" is a 10-% aqueous solution of a neutral detergent having a pH of 7 for cleaning precision measurement apparatus, contains a nonionic surfactant, an anionic surfactant, and an organic builder, and is manufactured by Wako Pure Chemical Industries, Ltd.

(3) An ultrasound disperser "Ultrasonic Dispersion System Tetora 150" (Nikkaki Bios Co., Ltd.) which has an electric output of 120 W and in which two oscillators each having an oscillating frequency of 50 kHz are provided with a phase shift of 1800 is prepared. Approximately 3.3 L of ion-exchanged water is charged into a water tank of the ultrasonic disperser, and approximately 2 mL of the above Contaminon N is added to this water tank.

(4) The beaker of the above (2) is placed in a beaker holding hole of the ultrasound disperser, and the ultrasound disperser is activated. In addition, the height position of the beaker is adjusted so that a liquid surface of the aqueous electrolyte solution in the beaker is placed in a maximum resonance state.

(5) While the aqueous electrolyte solution in the beaker of the above (4) is irradiated with an ultrasonic wave, approximately 10 mg of the toner particles is added little by little to the above aqueous electrolyte solution and is then dispersed. In addition, an ultrasound dispersing treatment is continued for another 60 seconds. During the ultrasound dispersing, the water temperature in the water tank is appropriately adjusted at 10° C. to 40° C.

(6) The aqueous electrolyte solution of the above (5) in which the toner particles are dispersed is dripped using a pipette into the round-bottom beaker of the above (1) set to the sample stand, and the measurement concentration is adjusted to approximately 5%. In addition, the measurement is performed until the number of measured particles reaches 50,000.

(7) The measurement data is analyzed by the dedicated software attached to the device, and the weight-average particle diameter (D4) and the number average particle diameter (D1) are calculated. When the dedicated software is set to graph/volume %, the "average diameter" on the "analysis/volume statistics (arithmetic average)" screen indicates the weight average particle diameter (D4), and when the dedicated software is set to graph/number %, the "average diameter" on the "analysis/number statistics (arithmetic average)" screen indicates the number average particle diameter (D1).

<Measurement of Glass Transition Temperature (Tg) of Amorphous Polyester Resin>

The glass transition temperature of the crystalline polyester resin is measured using DSC Q2000 (manufactured by TA Instruments). In addition, the measurement start time and the measurement finish time are set to 20° C. and 180° C., respectively.

The temperature correction of a device detection portion is performed using the melting points of indium and zinc, and the correction of the amount of heat is performed using the heat of melting of indium. In particular, after approximately 2 mg of a sample is precisely measured and is then placed in an aluminum-made pan, a first measurement is performed. As a reference, an empty aluminum-made pan is also used. The measurement is performed in such a way that after the temperature is increased from 20° C. to 200° C. at an increase rate of 10° C./min and is then decreased to 20° C. at a decrease rate of 10° C./min, the temperature is again increased to 180° C. at an increase rate of 10° C./min. In a reversing heat flow curve at the second temperature increase obtained by a DSC measurement, a temperature (° C.) at the intersection is regarded as the glass transition temperature, the intersection being located between a curved line of a step-wise changing portion of the glass transition in the reversing heat flow curve and a straight line passing through the center in a vertical axis direction between two lines extending from the base lines obtained before and after the change in specific heat.

<Measurement Method of Number Average Molecular Weight (Mn) and Weight Average Molecular Weight (Mw)>

The molecular weights (Mn and Mw) of tetrahydrofuran (THF) soluble components of various types of resins are measured as described below using a gel permeation chromatography (GPC).

First, a sample is dissolved in THF at room temperature over 24 hours. Subsequently, the solution thus obtained is filtrated using a solvent-resistant membrane filter "Maishori Disk" (manufactured by Tosoh Corp.) having a pore diameter of 0.2 μm, so that a sample solution is obtained. In addition, the sample solution is prepared so that the concentration of a THF-soluble component is approximately 0.8 percent by mass. By the use of this sample solution, the measurement is performed under the following conditions.

Apparatus: HLC 8120 GPC (detector: RI) (manufactured by Tosoh Corp.)

Columns: Shodex KF-801, 802, 803, 804, 805, 806, and 807, those seven columns being connected in series (manufactured by Showa Denko K.K.)

Eluent: tetrahydrofuran (THF)

Flow rate: 1.0 ml/min

Oven temperature: 40.0° C.

Sample charge amount: 0.10 ml

For calculation of the molecular weight of the sample, a molecular weight calibration curve formed using standard polystyrene resins (trade name "TSK Standard Polystyrene F-850, F-450, F-288, F-128, F-80, F-40, F-20, F-10, F-4, F-2, F-1, A-5000, A-2500, A-1000, and A-500" manufactured by Tosoh Corp.) is used.

<Measurement Method of Particle Diameters of Wax Fine Particles, Colorant Fine Particles, and Resin Fine Particles>

The particle diameters of fine particles, such as the wax fine particles, the colorant fine particles, and the resin fine particles, are each measured as the volume average particle diameter by a microtrack particle size distribution measurement device HRA (X-100) (manufactured by Nikkiso Co., Ltd.) in a range of 0.001 to 10 μm.

EXAMPLES

Hereinafter, although the present disclosure will be described in more detail with reference to manufacturing examples and examples, the present disclosure is not limited thereto. In addition, the part(s) and the percentage of the compositions described below are all mass basis unless otherwise particularly noted.

<Organic Polysiloxane Compound X1 Having Vinyl Group>

A commercially available one-terminal vinyl modified organic polysiloxane was prepared and used as an organic polysiloxane compound having a vinyl group. The structure of the organic polysiloxane having a vinyl group is represented by the following formula (II), and the substituents $R^2$ to $R^5$ and the value of the degree of polymerization n are shown in Table 1.

(II)

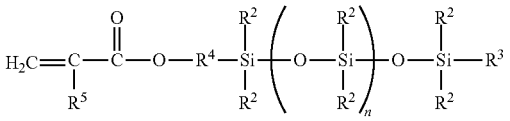

TABLE 1

| — | Product name | Name of Producer | Molecular weight | $R^2$ | $R^3$ | $R^4$ | $R^5$ | Degree of polymerization n |
|---|---|---|---|---|---|---|---|---|
| Organic polysiloxane compound X1 having vinyl group | X-22-2475 | Shin-Etsu Chemical Co., Ltd. | 420 | Methyl group | Methyl group | Propylene Group | Methyl group | 3 |

<Ether Compound 1 Having Vinyl Group>

A commercially available one-terminal vinyl modified ether compound was prepared and used as an ether compound having a vinyl group. The structure of the ether compound having a vinyl group is represented by the following formula (IV), and the details of $R^6$ and $R^7$ and the value of the degree of polymerization n are shown in Table 2. In addition, the structure of the ether monomer was represented using catalogue values.

(IV)

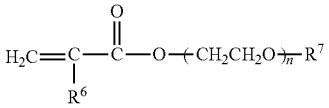

TABLE 2

| — | Product name | Name of Producer | R6 | R7 | n | Molecular weight |
|---|---|---|---|---|---|---|
| Ether compound 1 having vinyl group | Light Acrylate 130A | Kyoeisha Chemical Co., Ltd. | Hydrogen | Methyl group | 9 | 536 |

<Preparation of Resin A1>

The following raw materials and 160.0 parts of toluene were charged into an air-tight container and were then completely dissolved by heating to 70° C., so that a monomer solution A1 was prepared.

Organic polysiloxane compound X1 having a vinyl group: 30.0 parts

Ether compound 1 having a vinyl group: 25.0 parts

Styrene: 35.0 parts

Methacrylic acid: 10.0 parts

After the temperature of the above monomer solution A1 was decreased to 25° C., and 0.16 parts of azobisisobutyronitrile (AIBN) functioning as a polymerization initiator was mixed therewith, the mixture thus prepared was charged into a reaction container equipped with a stirring device and a thermometer while nitrogen purge was performed. After heating was performed to 65° C., the polymerization was performed over 5 hours. After the temperature was decreased to room temperature, toluene functioning as the solvent was removed by distillation, so that a resin A1 was obtained. The weight average molecular weight (Mw) of the resin A1 thus obtained and the SP value obtained by calculation are shown in Table 3.

<Preparation of Resins A2 to A10>

In the preparation of the resin A1, the addition amounts of the organic polysiloxane having a vinyl group and the ether compound having a vinyl group were changed as shown in Table 3, so that resins A2 to A10 were obtained. The weight average molecular weights (Mw) of the resins A2 to A10 thus obtained and the SP values thereof obtained by calculation are shown in Table 3.

TABLE 3

| Type of resin A | Organic polysiloxane compound X1 having vinyl group Addition amount (parts) | Ether compound 1 having vinyl group Addition amount (parts) | Styrene Addition amount (parts) | Methacrylic acid Addition amount (parts) | Mw | SP Value |
|---|---|---|---|---|---|---|
| A1 | 30 | 25 | 35 | 10 | 124000 | 16.6 |
| A2 | 10 | 10 | 70 | 10 | 130200 | 18.7 |
| A3 | 2 | 6 | 82 | 10 | 136000 | 19.5 |
| A4 | 4 | 8 | 78 | 10 | 138000 | 19.2 |
| A5 | 6 | 10 | 74 | 10 | 131000 | 19.0 |
| A6 | 30 | 10 | 50 | 10 | 125000 | 17.1 |
| A7 | 40 | 20 | 30 | 10 | 117000 | 16.0 |
| A8 | 40 | 25 | 25 | 10 | 126000 | 15.8 |
| A9 | 40 | 35 | 15 | 10 | 120500 | 15.5 |
| A10 | 0 | 25 | 65 | 10 | 143000 | 18.9 |

<Preparation of Resin Solutions A1 to A10>

Each of the resins A1 to A10 in an amount of 10.0 parts was dissolved in 90.0 parts of acetone, so that resin solutions A1 to A10 each having a solid component concentration of 10.0 parts by mass were prepared.

<Synthesis of Polyester 1 Having Polymerizable Unsaturated Group>

The following raw materials were charged in a two-necked flask dried by heating while nitrogen was introduced thereinto.

Sebacic acid: 128.0 parts

Fumaric acid: 2.6 parts 1,6-Hexanediol: 78.5 parts

Dibutyltin oxide: 0.1 parts

After the inside of the system was replaced with nitrogen by a reduced-pressure operation, stirring was performed at 180° C. for 6 hours. Subsequently, the temperature was gradually increased to 230° C. at a reduced pressure while the stirring was performed and was further maintained for 2 hours. When a viscous state was obtained, air cooling was performed to stop the reaction, so that a polyester having a polymerizable unsaturated group was synthesized. The polyester having a polymerizable unsaturated group had a melting point of 56° C., an Mn of 19,000, and an Mw of 44,000.

<Preparation of Polyfunctional Monomer 1>

A commercially available polyfunctional monomer was prepared and used. The structure of the polyfunctional monomer is represented by the following formula (V), and the total of degrees of polymerization m and n is shown in Table 4.

(V)

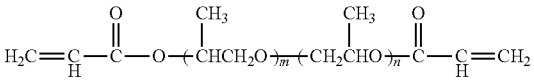

TABLE 4

| — | Product name | Name of Producer | Molecular weight | m + n |
|---|---|---|---|---|
| Polyfunctional monomer 1 | APG400 | Shin-Nakamura Chemical Co., Ltd. | 536 | 7 |

<Preparation of Resin Fine Particle Dispersion Liquid B1>

Into a beaker equipped with a stirring device, 2.0 parts of sodium dodecyl sulfate and 1,600.0 parts of ion-exchanged water were charged and then stirred at 25° C. until the sulfate was completely dissolved, so that an aqueous medium 1 was prepared. Next, the following raw materials and 160.0 parts of toluene were charged into an air-tight container and were then completely dissolved by heating to 70° C., so that a monomer solution B1 was prepared.

Organic polysiloxane compound X1 having a vinyl group: 45.0 parts

Polyester 1 having a polymerizable unsaturated group: 40.0 parts

Styrene: 5.0 parts

Methacrylic acid: 10.0 parts

Polyfunctional monomer 1: 4.0 parts

After the temperature of the monomer solution B1 described above was decreased to 25° C., 6.0 parts of tertiary butyl peroxy pivalate functioning as a polymerization initiator was mixed therewith, and the mixture thus formed was then added to the above aqueous medium 1. In addition, an ultrasonic wave was irradiated for 13 minutes (intermittently with one-second intervals at 25° C.) by a high-output ultrasonic homogenizer (VCX-750), so that an emulsified liquid of the above monomer solution B1 was prepared.

After the above emulsified liquid was charged into a four-necked flask dried by heating and was then bubbled with nitrogen for 30 minutes while being stirred at 200 rpm, stirring was performed at 75° C. for 6 hours. Subsequently, while the emulsified liquid was stirred, air cooling was performed to stop the reaction, so that a dispersion of coarsely particulate resin B1 was obtained.

The dispersion of the coarsely particulate resin B1 was charged in a temperature-controllable stirring tank and then transferred by a pump to Clear SS5 (manufactured by M Technique Co., Ltd.) at a flow rate of 35 g/min for treatment, so that a dispersion of a finely particulate resin B1 was obtained. As the process conditions of the dispersion by Clear SS5, the circumference velocity of the outermost circumference portion of a rotatable ring disc of Clear SS5 was set to 15.7 m/s, and the gap between the rotatable ring disc and a fixed rind disc was set to 1.6 μm. In addition, the temperature of the stirring tank was set so that the liquid temperature after the treatment performed by Clear SS5 was 40° C. or less. The finely particulate resin B1 and toluene in the dispersion were separated by a centrifugal machine at 16,500 rpm for 2.5 hours, and a supernatent was then removed, so that a condensed dispersion of resin fine particles was obtained.

Subsequently, the condensed dispersion of resin fine particles was dispersed in acetone in a beaker equipped with a stirring device using a high-output ultrasonic wave homogenizer (VCX-750), so that a resin fine particle dispersion liquid B1 having a solid component concentration of 10.0 percent by mass was prepared. The measured volume average diameter of the resin fine particles was 0.09 μm.

<Preparation of Resin Fine Particle Dispersion Liquids B2 to B8>

In the preparation of the resin fine particle dispersion liquid B1, the addition amounts of the polyester having a polymerizable unsaturated group, the organic polysiloxane compound having a vinyl group, and the polyfunctional monomer were changed as shown in Table 5, so that resin fine particle dispersion liquids B2 to B8 were obtained. The weight average molecular weight (Mw) of the resin fine particles contained in each of the resin fine particle dispersion liquids B2 to B8 thus obtained and the SP value thereof obtained by calculation are shown in Table 5.

TABLE 5

| Resin fine particle dispersion liquid | Organic polysiloxane compound X1 having vinyl group Addition amount (parts) | Polyester compound 1 having polymerizable unsaturated group Addition amount (parts) | Styrene Addition amount (parts) | Methacrylic acid Addition amount (parts) | Polyfunctional monomer 1 Addition amount (parts) | Particle diameter (μm) | SP Value |
|---|---|---|---|---|---|---|---|
| B1 | 45 | 40 | 5 | 10 | 4.0 | 0.09 | 15.3 |
| B2 | 15 | 40 | 35 | 10 | 4.0 | 0.09 | 17.7 |
| B3 | 16 | 40 | 34 | 10 | 4.0 | 0.09 | 17.7 |
| B4 | 35 | 50 | 5 | 10 | 4.0 | 0.09 | 15.9 |
| B5 | 56 | 29 | 5 | 10 | 4.0 | 0.09 | 14.7 |
| B6 | 60 | 25 | 5 | 10 | 4.0 | 0.10 | 14.5 |
| B7 | 30 | 30 | 30 | 10 | 4.0 | 0.09 | 16.8 |
| B8 | 45 | 40 | 5 | 10 | 2.0 | 0.13 | 15.3 |

<Preparation of Amorphous Polyester 1>

The following raw materials were charged into a two-necked flask dried by hearing while nitrogen was introduced thereinto.

Polyoxypropylene (2,2)-2,2-bis(4-hydroxyphenyl)propane: 59.0 parts

Ethylene glycol: 7.0 parts

Terephthalic acid: 31.0 parts

Trimellitic anhydride: 3.0 parts

Dibutyltin oxide: 0.3 parts

After the inside of the system was replaced with nitrogen by a reduced-pressure operation, stirring was performed at 215° C. for 5 hours. Subsequently, while the stirring was performed, the temperature was gradually increased to 230° C. at a reduced pressure and was further maintained for 2 hours. When a viscous state was obtained, air cooling was performed to stop the reaction, so that an amorphous polyester 1 was obtained. The amorphous polyester 1 had an Mn of 2,600, an Mw of 9,500, and a Tg of 69° C.

<Preparation of Amorphous Polyester Solution 1>

After 128.0 parts of acetone functioning as an organic solvent and 72.0 parts of the amorphous polyester 1 were charged into a beaker equipped with a stirring device, heating was performed to 50° C. with stirring until the polyester was completely dissolved, so that an amorphous polyester solution 1 having a solid component of 36.0 percent by mass was prepared.

<Preparation of Colorant Dispersion Liquid 1>

C.I. Pigment Blue 15: 3: 100.0 parts

Acetone: 150.0 parts

Glass beads (1 mm): 300.0 parts

After the above materials were charged into a heat-resistant glass container and then dispersed for 5 hours by a paint shaker (manufactured by Toyo Seiki Co., Ltd.), the glass beads were removed by a nylon mesh, so that a colorant dispersion liquid 1 having a volume average particle diameter of 200 nm and a solid component of 40.0 percent by mass was obtained.

<Preparation of Wax Dispersion Liquid 1>

Dipentaerythritol palmitic acid ester wax: 16.0 parts

Wax dispersing agent: 8.0 parts (A copolymer having a peak molecular weight of 8,500 formed by graft-copolymerization among 50.0 parts of styrene, 25.0 parts of n-butyl acrylate, and 10.0 parts of acrylonitrile in the presence of 15.0 parts of a polyethylene)

Acetone: 76.0 parts

After the above materials were charged in a glass beaker equipped with a stirring blade, the inside of the system was heated to 50° C., so that the wax was dissolved in acetone. Subsequently, the inside of the system was gradually cooled to 25° C. over 3 hours while stirring was moderately performed at 50 rpm, so that a milky white liquid was obtained. After this solution was charged in a heat-resistant container together with 20.0 parts of glass beads having a size of 1 mm and then dispersed for 3 hours by a paint shaker, the glass beads were removed by a nylon mesh, so that a wax dispersion liquid 1 having a volume average particle diameter of 270 nm and a solid component of 24.0 percent by mass was obtained.

(Manufacturing of Toner Particles)

<Manufacturing of Toner Particles 1>

Figure 2:
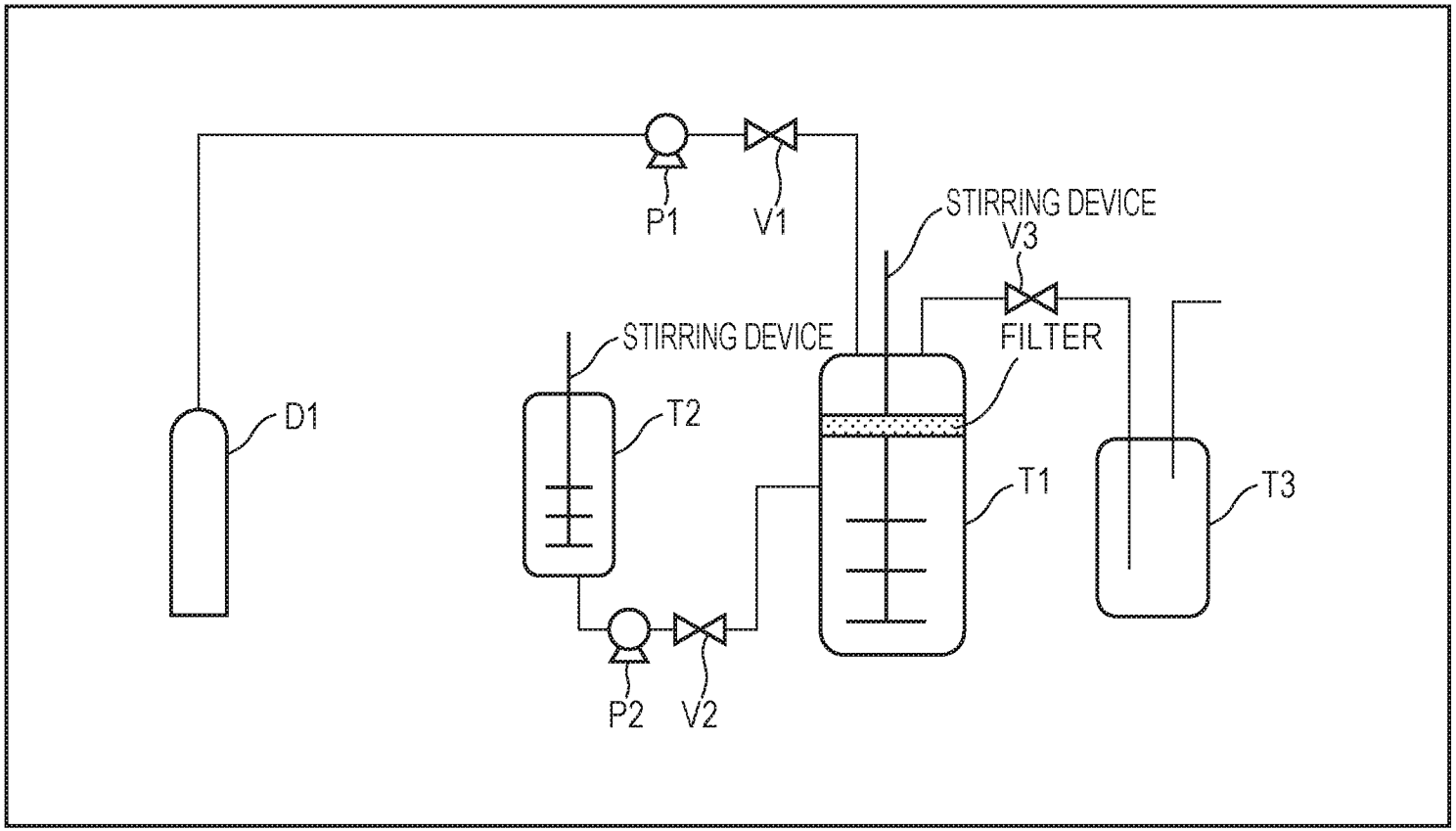
FIG. 2 is a view showing one example of a manufacturing method and a manufacturing apparatus of a toner.

In an apparatus shown in FIG. 2, first, valves V1, V2 and a pressure control valve V3 were closed. Next, in a pressure-resistant granulation tank T1 provided with a filter trapping toner particles and a stirring device, 14.4 parts of the resin fine particle dispersion liquid B1 was charged, and the inside temperature was controlled at 40° C. Next, after the valve V1 was opened, carbon dioxide (purity: 99.99%) was introduced into the granulation tank T1 from a carbon dioxide cylinder D1 using a pump P1, and the valve V1 was closed when the inside pressure reached 2.0 MPa.

In addition, after the following amounts of the amorphous polyester solution 1, the resin solution A1, the colorant dispersion liquid 1, and the wax dispersion liquid 1 were charged in a resin solution tank T2 to prepare a resin solution, the inside temperature was controlled at 40° C. The valve V2 was opened, and while the inside of the granulation tank T1 was stirred at 2,000 rpm, the resin solution in the resin solution tank T2 was charged into the granulation tank T1 using a pump P2. Next, when the resin solution was all charged into the tank T1, the valve V2 was closed. After the resin solution was charged, the inside pressure of the granulation tank T1 reached 3.0 MPa. The total mass of the carbon dioxide thus charged was 280.0 parts measured by a mass flow meter.

The charge amounts (mass ratios) of the materials to the resin solution tank T2 were as described below.

Amorphous polyester solution 1: 100.0 parts

Resin A solution 1: 18.0 parts

Wax dispersion liquid 1: 10.0 parts

Colorant dispersion liquid 1: 6.0 parts

After the contents in the resin solution tank T2 were all charged into the granulation tank T1, stirring was further performed at 2,000 rpm for 3 minutes, so that a dispersion of liquid droplets of the above resin solution was formed.

Next, after the valve V1 was opened, and carbon dioxide was charged into the granulation tank T1 from the carbon dioxide cylinder D1 using the pump P1, and the valve V1 was closed when the inside pressure reached 10.0 MPa. As described above, acetone contained in the liquid droplets in the dispersion was extracted to the dispersion medium.

Subsequently, the valve V1 and the pressure control valve V3 were opened, and while the inside pressure of the granulation tank T1 was maintained at 10.0 MPa, carbon dioxide was further charged using the pump P1. By this operation, carbon dioxide containing acetone as an extracted organic solvent was discharged to a solvent recovery tank T3, so that acetone and carbon dioxide were separated.

In addition, after carbon dioxide was started to be discharged to the organic solvent recovery tank T3, acetone therein was recovered at every 5 minutes. This operation was performed until acetone was no longer stored in the organic solvent recovery tank T3 and was no longer recovered therefrom. When acetone could not be recovered any more, it was regarded that solvent removal was completed, and the valve V1 and the pressure control valve V3 were closed, so that the flow of carbon dioxide was finished.

Furthermore, the pressure control valve V3 was opened, and the inside pressure of the granulation tank T1 was returned to atmospheric pressure, so that toner particles 1 trapped by the filter were recovered. The physical properties of the toner particles thus obtained are shown in Tables 6 and 7.

<Manufacturing of Toner Particles 2 to 25>

In the manufacturing of the toner particles 1, except that the type and the addition amount of the resin solution and the type and the addition amount of the resin fine particle dispersion liquid were changed as shown in Table 6, toner particles 2 to 25 were manufactured in a manner similar to that of the toner particles 1. The physical properties of the toner particles 2 to 25 thus obtained are shown in Tables 6 and 7.

TABLE 7

| Toner particle | SP Value | | | | Soluble component in resin (%) | |
|---|---|---|---|---|---|---|
| | | | | Relational formula of SP | | |
| No. | SP (A) | SP (B) | SP (C) | Value (3) | Resin A | Resin B |
| 1 | 16.6 | 15.3 | 20.0 | 3.4 | 99.0 | 10.2 |
| 2 | 18.7 | 17.7 | 20.0 | 1.3 | 99.0 | 9.8 |
| 3 | 16.6 | 15.9 | 20.0 | 3.4 | 99.0 | 10.3 |
| 4 | 16.6 | 14.7 | 20.0 | 3.4 | 99.0 | 11.4 |
| 5 | 16.6 | 15.3 | 20.0 | 3.4 | 99.0 | 10.2 |
| 6 | 16.6 | 15.3 | 20.0 | 3.4 | 99.0 | 10.2 |
| 7 | 16.6 | 15.3 | 20.0 | 3.4 | 99.0 | 10.2 |
| 8 | 19.2 | 15.3 | 20.0 | 0.8 | 99.0 | 10.2 |
| 9 | 19.0 | 15.3 | 20.0 | 1.0 | 99.0 | 10.2 |
| 10 | 17.1 | 15.3 | 20.0 | 2.9 | 99.0 | 10.2 |
| 11 | 16.0 | 15.3 | 20.0 | 4.0 | 99.0 | 10.2 |
| 12 | 15.8 | 15.3 | 20.0 | 4.2 | 99.0 | 10.2 |
| 13 | 16.6 | 15.3 | 20.0 | 3.4 | 99.0 | 10.2 |
| 14 | 16.6 | 15.3 | 20.0 | 3.4 | 99.0 | 10.2 |
| 15 | 16.6 | 15.3 | 20.0 | 3.4 | 99.0 | 26.8 |
| 16 | 18.7 | 17.7 | 20.0 | 1.3 | 99.0 | 9.5 |
| 17 | 16.6 | 14.5 | 20.0 | 3.4 | 99.0 | 11.6 |
| 18 | 16.6 | 15.3 | 20.0 | 3.4 | 99.0 | 10.2 |
| 19 | 16.6 | 15.3 | 20.0 | 3.4 | 99.0 | 10.2 |
| 20 | 19.5 | 15.3 | 20.0 | 0.5 | 99.0 | 10.2 |
| 21 | 15.5 | 15.3 | 20.0 | 4.5 | 99.0 | 10.2 |
| 22 | 16.0 | 17.7 | 20.0 | 4.0 | 99.0 | 9.8 |
| 23 | 16.6 | 16.8 | 20.0 | 3.4 | 99.0 | 9.6 |
| 24 | 18.9 | 15.3 | 20.0 | 1.1 | 99.0 | 10.2 |
| 25 | — | 15.3 | 20.0 | — | 99.0 | 10.2 |

<Preparation of Toners 1 to 25>

With respect to 100 parts of the toner particles 1, 1.8 parts of a hydrophobic silica fine powder (number average primary particle diameter: 7 nm) processed by hexamethyldisilazane and 0.15 parts of a rutile type titanium oxide fine

TABLE 6

| Toner particle | Resin A | | Resin B | | Surface Si amount of toner particles | Particle diameter of toner particles | Amount of Si present in region | Intensity counts of Si atoms in $P^0$ to $P^4$ (Normalized by assuming maximum intensity as 100) | | | | | | |
|---|---|---|---|---|---|---|---|---|---|---|---|---|---|---|
| No. | Type | Addition amount (parts) | Type | Addition amount (parts) | (atomic %) | (μm) | R (%) | $Si^0$ | $Si^1$ | $Si^2$ | $Si^3$ | $Si^0 - Si^1$ | $Si^1 - Si^2$ | $Si^2 - Si^3$ |
| 1 | A1 | 5.0 | B1 | 4.0 | 8.7 | 5.6 | 96 | 100 | 40 | 15 | 3 | 60 | 25 | 12 |
| 2 | A2 | 5.0 | B3 | 4.0 | 4.5 | 6.0 | 95 | 100 | 49 | 19 | 4 | 51 | 30 | 15 |
| 3 | A1 | 5.0 | B4 | 4.0 | 6.8 | 5.4 | 94 | 100 | 46 | 17 | 5 | 54 | 29 | 12 |
| 4 | A1 | 5.0 | B5 | 4.0 | 9.9 | 5.4 | 94 | 100 | 36 | 10 | 5 | 64 | 26 | 5 |
| 5 | A1 | 1.0 | B1 | 4.0 | 8.7 | 5.1 | 94 | 100 | 25 | 8 | 5 | 75 | 17 | 3 |
| 6 | A1 | 2.0 | B1 | 4.0 | 8.7 | 5.3 | 95 | 100 | 32 | 12 | 4 | 68 | 20 | 8 |
| 7 | A1 | 10.0 | B1 | 4.0 | 8.7 | 6.0 | 91 | 100 | 44 | 18 | 8 | 56 | 26 | 10 |
| 8 | A4 | 7.0 | B1 | 4.0 | 8.7 | 5.4 | 91 | 100 | 20 | 12 | 1 | 80 | 8 | 11 |
| 9 | A5 | 5.0 | B1 | 4.0 | 8.7 | 5.6 | 92 | 100 | 24 | 9 | 7 | 76 | 15 | 2 |
| 10 | A6 | 5.0 | B1 | 4.0 | 8.7 | 5.8 | 96 | 100 | 29 | 9 | 3 | 71 | 20 | 6 |
| 11 | A7 | 5.0 | B1 | 4.0 | 8.7 | 5.9 | 98 | 100 | 43 | 6 | 1 | 57 | 37 | 5 |
| 12 | A8 | 7.0 | B1 | 4.0 | 8.7 | 6.2 | 98 | 100 | 58 | 3 | 1 | 42 | 55 | 2 |
| 13 | A1 | 5.0 | B1 | 3.0 | 8.7 | 6.4 | 96 | 100 | 44 | 15 | 1 | 56 | 29 | 14 |
| 14 | A1 | 5.0 | B1 | 10.0 | 8.7 | 4.7 | 98 | 100 | 41 | 11 | 1 | 59 | 30 | 10 |
| 15 | A1 | 5.0 | B8 | 4.0 | 7.0 | 6.0 | 97 | 100 | 42 | 11 | 1 | 58 | 31 | 10 |
| 16 | A2 | 5.0 | B2 | 4.0 | 4.1 | 6.4 | 95 | 100 | 52 | 21 | 4 | 48 | 31 | 17 |
| 17 | A1 | 5.0 | B6 | 4.0 | 10.3 | 5.4 | 95 | 100 | 33 | 8 | 4 | 67 | 25 | 4 |
| 18 | A1 | 0.5 | B1 | 4.0 | 8.7 | 5.0 | 99 | 100 | 16 | 1 | 1 | 84 | 15 | 0 |
| 19 | A1 | 12.0 | B1 | 4.0 | 8.7 | 6.0 | 82 | 100 | 48 | 22 | 16 | 52 | 26 | 6 |
| 20 | A3 | 5.0 | B1 | 4.0 | 8.7 | 5.7 | 87 | 100 | 16 | 11 | 11 | 84 | 5 | 0 |
| 21 | A9 | 5.0 | B1 | 4.0 | 8.7 | 5.7 | 97 | 100 | 87 | 1 | 1 | 13 | 86 | 0 |
| 22 | A7 | 5.0 | B3 | 4.0 | 4.5 | 6.8 | 96 | 100 | 84 | 2 | 2 | 16 | 82 | 0 |
| 23 | A1 | 5.0 | B7 | 4.0 | 5.3 | 6.4 | 96 | 100 | 86 | 3 | 3 | 14 | 83 | 0 |
| 24 | A10 | 5.0 | B1 | 4.0 | 8.7 | 5.5 | 98 | 100 | 1 | 1 | 0 | 99 | 0 | 1 |
| 25 | — | — | B1 | 4.0 | 8.7 | 5.2 | 98 | 100 | 1 | 1 | 1 | 99 | 0 | 0 |

powder (number average primary particle diameter: 30 nm) were dry-mixed for 5 minutes by a Mitsui Henschel Mixer (manufactured by Mitsui Miike Machinery Co., Ltd.), so that a toner 1 was obtained. An operation similar to that performed on the above toner particles 1 was also performed on each of the toner particles 2 to 25, so that toners 2 to 25 were obtained.

Examples 1 to 15, Comparative Examples 1 to 10

The following evaluations were performed on the toners 1 to 25 thus obtained.

<Long Term Storage in Severe Environment>

Figure 3:
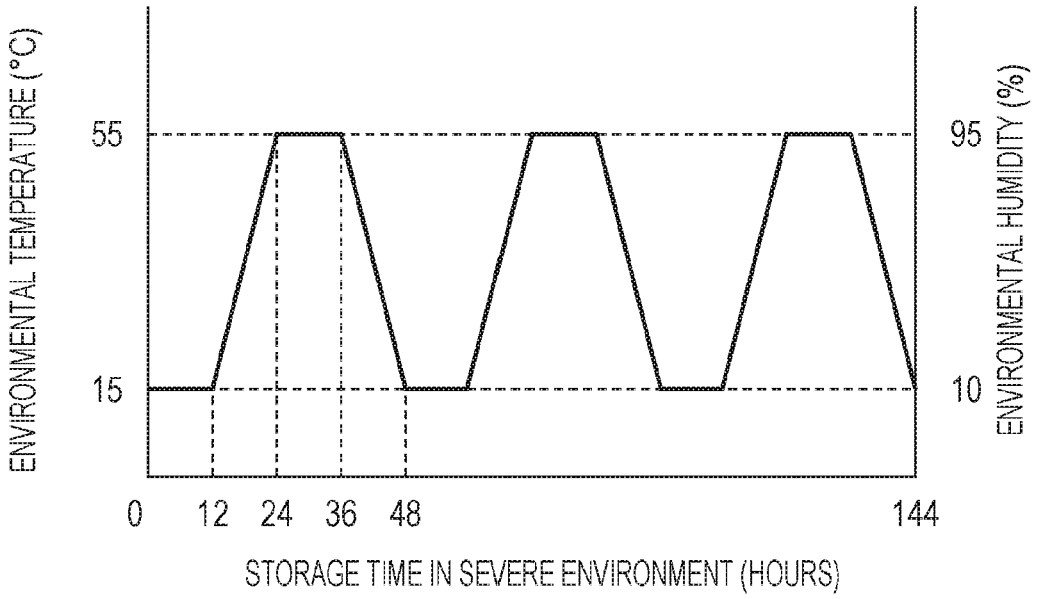
FIG. 3 is a view showing a time chart of a heat cycle.

First, after approximately 100 g of each of the toners 1 to 25 thus obtained was received in a resin-made cup having a volume of 1,000 ml and was then left for 12 hours in a low-temperature and low-humidity environment (15° C., 10% RH), the environment was changed to a high-temperature and high-humidity environment (55° C., 95% RH) over 12 hours. After the toner was left for 12 hours in the high-temperature and high-humidity environment, the environment was again changed to the low-temperature and low-humidity environment (15° C., 10% RH) over 12 hours. After the operation described above was repeatedly performed three times, the toner was recovered and used for the evaluation of environmental stability and durability. A time chart of the heat cycle is shown in FIG. 3.

<Environmental Stability>

As for the toners left for a long period of time in the above severe environments, the difference between the charge amount in a low-temperature and low-humidity (LL) environment and that in a high-temperature and high-humidity (HH) environment was evaluated by the following method.

(Preparation of Sample)

After 1.0 g of the toner and 19.0 g of a predetermined carrier (standard carrier of The Imaging Society of Japan: spherical carrier N-01 obtained by a surface treatment performed on ferrite cores) were received in a plastic bottle having a lid, the bottle was then left in an LL environment having a temperature of 15° C. and a relative humidity of 10% and an HH environment having a temperature of 32.0° C. and a relative humidity of 85% for 5 days.

(Measurement of Charge Amount)

Figure 4:
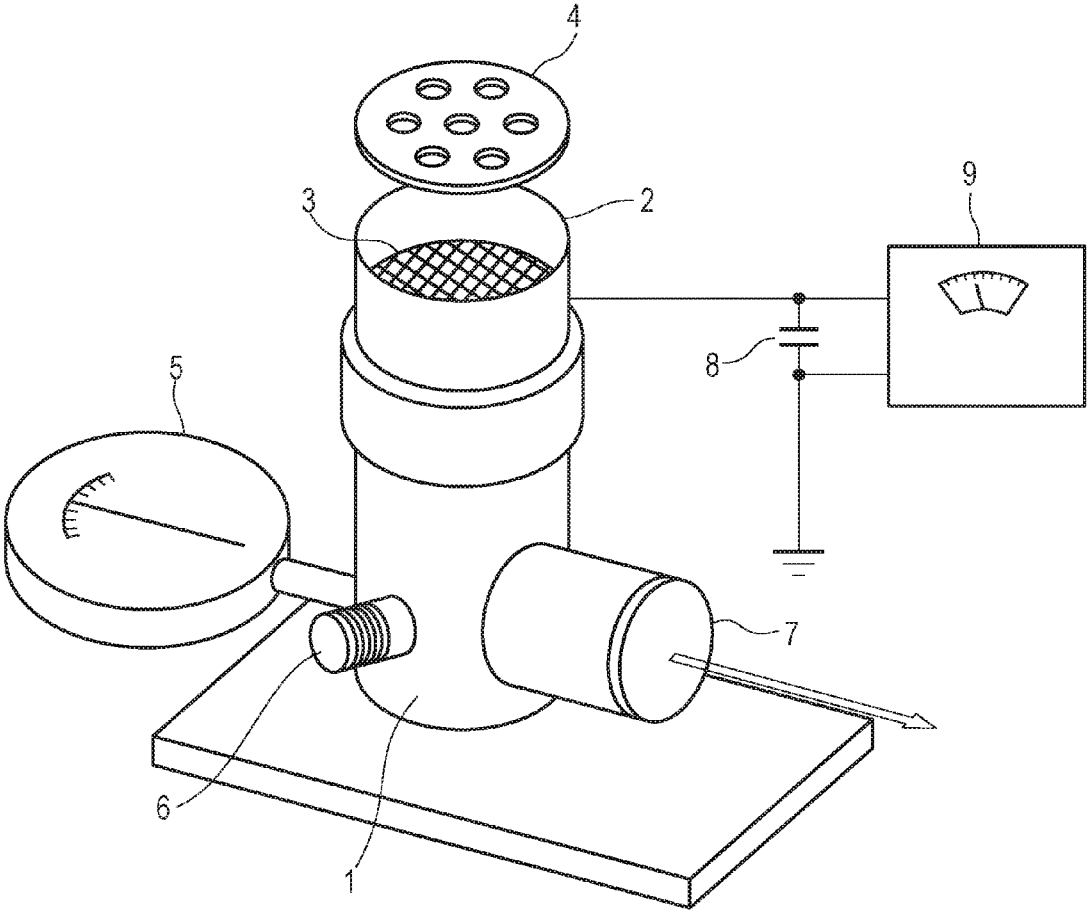
FIG. 4 is a view showing one example of a device for measuring a charge amount of a toner.

After the plastic bottle receiving the above carrier and the above toner was closed with the lid and then was shook for one minute in a reciprocal manner at a rate of four times per second by a shaking device (YS-LD, manufactured by Yayoi Co., Ltd.), so that a developer formed of the toner and the carrier was electrically charged. Next, the triboelectric charge quantity was measured by a device measuring a triboelectric charge quantity shown in FIG. 4. In FIG. 4, in a metal-made measurement container in which a screen 3 having an opening of 20 μm was provided at a bottom, 0.5 to 1.5 g of the developer was charged, and a metal-made lid 4 was put on the container 2. A mass W1 (g) of the total measurement container 2 in this case was precisely measured. Next, by a suction machine 1 (portion in contact with the measurement container 2 was at least formed of an insulating material), the suction was performed from a suction port 7, and the pressure indicated by a vacuum gauge 5 was set to 2.5 kPa by adjustment of an airflow control valve 6. In the state described above, the suction was performed for 2 minutes, so that the toner was removed by the suction. The potential indicated by a potentiometer 9 in this case was represented by V (V). In addition, reference numeral 8 indicates a capacitor, and the capacity thereof is represented by C (mF). In addition, the mass of the total measurement container after the suction was performed was precisely measured and represented by W2 (g). A triboelectric charge quantity Q (mC/kg) of this sample was calculated from the following formula.

$$\text{Triboelectric Charge Quantity } Q \text{ of Sample (mC/kg)} = C \times V/(W1 - W2)$$

After the sample was left in the LL environment and then shook, the triboelectric charge quantity thereof was immediately measured and represented by Ql (mC/kg), and after the sample was left in the HH environment and then shook, the triboelectric charge quantity thereof was immediately measured and represented by Qh (mC/kg), so that Qh/Ql was used as an index indicating the initial environmental stability. Furthermore, after an image was output on 20,000 sheets by a printer LBP9200C to be used for the evaluation of durability which will be described later, the toner was recovered from a cartridge, and the evaluation similar to that described above was performed, so that the environmental stability after 20,000 sheets were processed was evaluated. The evaluation results are shown in Table 8. In addition, from A to C ranks, the environmental stability was evaluated as good.

(Evaluation Criteria)

A: Qh/Ql is 0.95 or more.

B: Qh/Ql is 0.90 to less than 0.95.

C: Qh/Ql is 0.85 to less than 0.90.

D: Qh/Ql is less than 0.85.

(Durability)

By the use of a commercially available printer LBP9200C manufactured by CANON KABUSHIKI KAISHA, the evaluation of durability was performed. LBP9200C uses a one-component contact developing system, and the amount of toner on a developer carrier is controlled by a toner regulating member. After a toner contained in a commercially available cartridge was removed, and the inside thereof was cleaned by an air blow, 260 g of each of the toners 1 to 25 was filled in the cartridge, so that an evaluation cartridge was obtained. The above cartridge was fitted to a cyan station, and dummy cartridges were fitted to the remaining stations, so that the evaluation was performed.

In a low-temperature and low-humidity environment at 15° C. and 10% RH, an image having a printing ratio of 1% was continuously output. A solid image and a halftone image were output at every 100 sheets, and the presence or absence of a development stripe caused by toner melt adhesion to the toner regulating member was confirmed by visual inspection. Finally, image output was performed on 20,000 sheets. The evaluation results are shown in Table 8. In addition, from A to C ranks, the durability was evaluated as good.

(Evaluation Criteria)

A: No developing stripe is generated even on 20,000$^{th}$ sheet.

B: Developing stripe is generated from more than 18,500 to 20,000 sheets.

C: Developing stripe is generated from more than 17,000 to 18,500 sheets.

D: Developing stripe is generated from more than 15,000 to 17,000 sheets.

E: Developing stripe is generated at 15,000 sheets or less.

<Evaluation of Low-Temperature Fixability>

For the evaluation of the low-temperature fixability, the toners 1 to 25 were used without being left for a long period of time in the above severe environments. Two-component developers 1 to 25 were each prepared by mixing 8.0 parts of each of the toners 1 to 25 and 92.0 parts of the carrier. For the evaluation, the two-component developers 1 to 25 and an evaluation machine obtained by modification of a color laser copying machine CLC5000 (manufactured by CANON KABUSHIKI KAISHA) were used. The developing contrast of the above copying machine was adjusted to have a toner bearing amount of 1.2 mg/cm$^2$ on CLC5000 paper, and a "solid" unfixed image having a front edge margin of 5 mm, a width of 100 mm, and a length of 280 mm was formed in a mono color mode in a normal-temperature and normal-humidity environment (23° C., 60% RH). As the paper, A4 thick paper ("Prover Bond Paper": 105 g/m$^2$, manufactured by Fox River Co.) was used.

Next, a fixing device of LBP5900 (manufactured by CANON KABUSHIKI KAISHA) was modified so that the fixing temperature could be manually set, and the rotation rate and the nip inside pressure of the fixing device were changed to 270 mm/s and 120 kPa, respectively. By the use of the above modified fixing device, in the normal-temperature and normal-humidity environment (23° C., 60% RH), while the fixing temperature was increased by 10° C. from 80° C. to 180° C., a fixed image of the above "solid" unfixed image was obtained at each temperature.

After soft thin paper (such as trade name "Dusper", manufactured by Ozu Corporation) was placed to cover an image region of the fixed image thus obtained, a load of 4.9 kPa was placed on the soft paper and was then rubbed on the image region five times in a reciprocal manner. The image densities before and after the rubbing were measured, and a decrease rate ΔD (%) of the image density was calculated by the following formula. A temperature at which this ΔD (%) was less than 10% was regarded as a fixing start temperature, and the low-temperature fixability was evaluated by the following evaluation criteria.

(Formula): $\Delta D(\%)$=(Image density before rubbing-image density after rubbing)/image density before rubbing×100

In addition, the image density was measured by a color reflection densitometer X-Rite 404A (manufactured by X-Rite). From A to C ranks, the low-temperature fixability was evaluated as good.

(Evaluation Criteria)

A: The fixing start temperature is 100° C. or less.

B: The fixing start temperature is 110° C.

C: The fixing start temperature is 120° C.

D: The fixing start temperature is 130° C. or more.

TABLE 8

| | | | Environmental stability | | Durability | Low- |
|---|---|---|---|---|---|---|
| — | Toner particle No. | Toner No. | At initial stage (Qh/Ql) | After output of 20,000 sheets (Qh/Ql) | Number of sheets for generation of development stripe (sheets) | temperature fixability (° C.) |
| Example 1 | 1 | 1 | A (0.97) | A (0.96) | A (No generation on 20,000$^{th}$ sheet) | A (100) |
| Example 2 | 2 | 2 | C (0.89) | C (0.88) | A (No generation on 20,000$^{th}$ sheet) | A (100) |
| Example 3 | 3 | 3 | B (0.94) | B (0.92) | A (No generation on 20,000$^{th}$ sheet) | A (100) |
| Example 4 | 4 | 4 | A (0.98) | C (0.89) | C (17200) | A (100) |
| Example 5 | 5 | 5 | C (0.89) | C (0.88) | B (19200) | A (100) |
| Example 6 | 6 | 6 | B (0.93) | B (0.90) | A (No generation on 20,000$^{th}$ sheet) | A (100) |
| Example 7 | 7 | 7 | A (0.98) | A (0.96) | A (No generation on 20,000$^{th}$ sheet) | C (120) |
| Example 8 | 8 | 8 | C (0.86) | C (0.85) | B (18900) | A (100) |
| Example 9 | 9 | 9 | C (0.89) | C (0.87) | B (19400) | A (100) |
| Example 10 | 10 | 10 | B (0.94) | B (0.92) | A (No generation on 20,000$^{th}$ sheet) | A (100) |
| Example 11 | 11 | 11 | C (0.89) | C (0.88) | B (19600) | A (100) |
| Example 12 | 12 | 12 | C (0.87) | C (0.86) | B (19000) | A (100) |
| Example 13 | 13 | 13 | B (0.93) | B (0.91) | B (19100) | A (100) |
| Example 14 | 14 | 14 | A (0.98) | A (0.96) | A (No generation on 20,000$^{th}$ sheet) | C (120) |
| Example 15 | 15 | 15 | A (0.98) | B (0.94) | B (19200) | A (100) |
| Comparative Example 1 | 16 | 16 | D (0.84) | D (0.81) | B (18700) | A (100) |
| Comparative Example 2 | 17 | 17 | A (0.99) | D (0.83) | E (14800) | A (100) |
| Comparative Example 3 | 18 | 18 | C (0.85) | D (0.81) | B (18600) | A (100) |
| Comparative Example 4 | 19 | 19 | A (0.99) | A (0.97) | A (No generation on 20,000$^{th}$ sheet) | D (130) |
| Comparative Example 5 | 20 | 20 | C (0.86) | D (0.82) | B (18900) | A (100) |
| Comparative Example 6 | 21 | 21 | C (0.85) | D (0.81) | B (19000) | A (100) |
| Comparative Example 7 | 22 | 22 | C (0.85) | D (0.78) | C (17800) | A (100) |
| Comparative Example 8 | 23 | 23 | C (0.86) | D (0.79) | C (17900) | A (100) |
| Comparative Example 9 | 24 | 24 | C (0.86) | D (0.81) | C (18200) | A (100) |
| Comparative Example 10 | 25 | 25 | C (0.85) | D (0.81) | C (18000) | A (100) |

Accordingly, the above disclosure can provide a toner excellent not only in charging stability and environmental stability but also in low-temperature fixability and durability and a method for manufacturing the toner.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-147265 filed Jul. 27, 2016, which is hereby incorporated by reference herein in its entirety.

What is claimed is:

1. A toner comprising:

toner particles which contain a binder resin, a colorant, a wax, and a resin A having an organic polysiloxane structure, wherein the amount (atomic %) of Si atoms of the toner particles measured by an X-ray photoelectron spectroscopy (XPS) is 4.5 to 10.0, in an analysis using an energy dispersive X-ray spectrometer (EDS) performed on a cross-section of each toner particle observed by a transmission electron microscope, in a surface layer region R from the periphery of the cross-section of the toner particle to the inside at a distance of 10.0% of the particle diameter in the cross-section of the toner particle, the content of Si atoms derived from the organic polysiloxane structure is 90.0% or more with respect to the total amount of Si atoms contained in the toner particle, and in a line analysis along a straight line between the periphery of the surface layer region R and a gravity center of the cross-section, an intensity count of Si atoms in the toner particle satisfies the following formula (1)

$$Si^0 > Si^1 > Si^2 > Si^3 \geq 0 \quad (1)$$

wherein in the formula (1), $Si^0$ represents the intensity count of Si atoms at an intersection $P^0$ between the straight line and the periphery, $Si^3$ represents the intensity count of Si atoms at an intersection $P^3$ between the straight line and a boundary line of the surface layer region R; and when points equally dividing a line segment $P^0P^3$ into three portions are represented by $P^1$ and $P^2$ in this order from the side close to the intersection $P^0$, $Si^1$ represents the intensity count of Si atoms at the intersection $P^1$, and $Si^2$ represents the intensity count of Si atoms at the intersection $P^2$.

2. The toner according to claim 1, wherein the resin A is a polymer of a monomer composition containing a compound X represented by the following formula (II), (II)

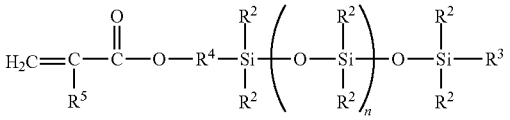

wherein in the formula, $R^2$ and $R^3$ each represent an alkyl group, $R^4$ represents an alkylene group, $R^5$ represents a hydrogen atom or a methyl group, and n represents the degree of polymerization and is an integer of 2 or more.

3. The toner according to claim 1, wherein the content of the resin A in the toner particle is 1.0 to 10.0 percent by mass.

4. The toner according to claim 1, wherein the toner particle has a surface layer derived from resin fine particles containing a resin B which has an organic polysiloxane structure, and a solubility parameter SP (A) of the resin A, a solubility parameter SP (B) of the resin B, and a solubility parameter SP (C) of the binder resin satisfy the following formulas (2) and (3)

$$SP(B) < SP(A) < SP(C) \quad (2)$$

$$1.0 \leq SP(C) - SP(A) \leq 4.0 \quad (3).$$

5. The toner according to claim 4, wherein the resin B is a polymer of a monomer composition containing a compound represented by the following formula (III), (III)

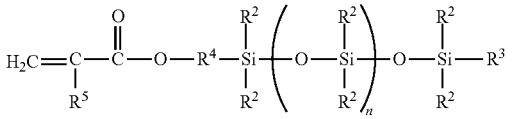

wherein in the formula, $R^2$ and $R^3$ each represent an alkyl group, $R^4$ represents an alkylene group, $R^5$ represents a hydrogen atom or a methyl group, and n represents the degree of polymerization and is an integer of 2 or more.

6. The toner according to claim 4, wherein the content of the resin B in the toner particle is 1.0 to 10.0 percent by mass.

7. The toner according to claim 4, wherein a soluble component of the resin A to an organic solvent is 90.0 percent by mass or more, and a soluble component of the resin B to the organic solvent is 30.0 percent by mass or less.

8. The toner according to claim 7, wherein the organic solvent is toluene, ethyl acetate, methyl ethyl ketone, tetrahydrofuran, acetone, or 2-phenylethanol.

9. A method for manufacturing a toner including toner particles which contains a binder resin, a colorant, a wax, and a resin A having an organic polysiloxane structure, the method comprising:

a) preparing a resin solution containing the binder resin, the colorant, the wax, the resin A having an organic polysiloxane structure, and an organic solvent;

b) mixing the resin solution, resin fine particles containing a resin B having an organic polysiloxane structure, and carbon dioxide to form liquid droplets of the resin solution each having a surface covered with the resin fine particles; and c) removing the organic solvent contained in the liquid droplets to form toner particles each having a surface layer derived from the resin fine particles, wherein the amount (atomic %) of Si atoms of the toner particles measured by an X-ray photoelectron spectroscopy (XPS) is 4.5 to 10.0, in an analysis using an energy dispersive X-ray spectrometer (EDS) performed on a cross-section of each toner particle observed by a transmission electron microscope, in a surface layer region R from the periphery of the cross-section of the toner particle to the inside at a distance of 10.0% of the particle diameter in the cross-section of the toner particle, the content of Si atoms derived from the organic polysiloxane structure is 90.0% or more with respect to the total amount of Si atoms contained in the toner particle, and in a line analysis along a straight line between the periphery of the surface layer region R and a gravity center of the cross-section, an intensity count of Si atoms in the toner particle satisfies the following formula (1)

$$Si^0 > Si^1 > Si^2 > Si^3 \geq 0 \quad (1)$$

wherein in the formula (1), $Si^0$ represents the intensity count of Si atoms at an intersection $P^0$ between the straight line and the periphery, $Si^3$ represents the intensity count of Si atoms at an intersection $P^3$ between the straight line and a boundary line of the surface layer region R; and when points equally dividing a line segment $P^0P^3$ into three portions are represented by $P^1$ and $P^2$ in this order from the side close to the intersection $P^0$, $Si^1$ represents the intensity count of Si atoms at the intersection $P^1$, and $Si^2$ represents the intensity count of Si atoms at the intersection $P^2$.

10. A toner comprising; toner particles which contains a binder resin, a colorant, a wax, and a resin A having an organic polysiloxane structure, wherein the amount (atomic %) of Si atoms of the toner particles measured by an X-ray photoelectron spectroscopy (XPS) is 4.5 to 10.0, in an analysis using an energy dispersive X-ray spectrometer (EDS) performed on a cross-section of each toner particle observed by a transmission electron microscope, in a surface layer region R from the periphery of the cross-section of the toner particle to the inside at a distance of 10.0% of the particle diameter in the cross-section of the toner particle, the content of Si atoms derived from the organic polysiloxane structure is 90.0% or more with respect to the total amount of Si atoms contained in the toner particle, and in a line analysis along a straight line between the periphery of the surface layer region R and a gravity center of the cross-section, the intensity of Si atoms has a gradient structure in which the intensity of Si atoms is decreased from the periphery to the gravity center.

* * * * *